US008967093B2

(12) United States Patent
Gokan et al.

(10) Patent No.: US 8,967,093 B2
(45) Date of Patent: Mar. 3, 2015

(54) PISTON COOLING SYSTEM

(71) Applicants: Honda Motor Co., Ltd., Tokyo (JP); Hikari Seiko Co., Ltd., Kuwana-shi, Mie (JP)

(72) Inventors: Yoshitsugu Gokan, Wako (JP); Kenichi Nishimura, Kuwana (JP); Keiji Yamamoto, Kuwana (JP); Masaki Sabato, Kuwana (JP)

(73) Assignees: Honda Motor Co., Ltd., Tokyo (JP); Hikari Seiko Co., Ltd., Kuwana-Shi (JP)

( * ) Notice: Subject to any disclaimer, the term of this patent is extended or adjusted under 35 U.S.C. 154(b) by 0 days.

(21) Appl. No.: 14/187,652

(22) Filed: Feb. 24, 2014

(65) Prior Publication Data

US 2014/0238317 A1 Aug. 28, 2014

(30) Foreign Application Priority Data

Feb. 28, 2013 (JP) ..... 2013-039914
Dec. 25, 2013 (JP) ..... 2013-267621

(51) Int. Cl.
*F01P 1/04* (2006.01)
*F01P 3/08* (2006.01)
*F02F 3/22* (2006.01)

(52) U.S. Cl.
CPC .... *F01P 3/08* (2013.01); *F02F 3/22* (2013.01)
USPC ..... 123/41.35; 239/552

(58) Field of Classification Search
USPC ..... 123/41.35, 196 R; 239/552
See application file for complete search history.

(56) References Cited

U.S. PATENT DOCUMENTS 5,915,345 A 6/1999 Kling et al.
2002/0014543 A1 2/2002 Ness
2008/0017139 A1 1/2008 Issler

FOREIGN PATENT DOCUMENTS

JP 2004-124938 4/2004

OTHER PUBLICATIONS

European Search Report dated Jun. 3, 2014.

*Primary Examiner* — Noah Kamen
(74) *Attorney, Agent, or Firm* — Rankin, Hill & Clark LLP

(57) ABSTRACT

A piston cooling system includes: a nozzle pipe portion which communicates with an oil passage which is provided in an internal combustion engine and which extends towards an interior of a cylinder bore; and a flow path forming member which is fixed to a distal end portion of the nozzle pipe portion and in which a plurality of oil jetting paths are formed, wherein: the distal end portion comprises an expanded pipe portion where the nozzle pipe portion is expanded and the flow path forming member is fittingly inserted into the expanded pipe portion; the flow path forming member has a distal end face which is exposed to an exterior portion at a distal end side of the expanded pipe portion; and the flow path forming member is locked in the expanded pipe portion by deforming a distal end edge of the expanded pipe portion.

10 Claims, 20 Drawing Sheets

PISTON COOLING SYSTEM

BACKGROUND

1. Field of the Invention

The present invention relates to a cooling system for a piston of an internal combustion engine and more particularly to a piston cooling system which cools a piston from a back side thereof by jetting oil.

2. Description of the Related Art

As a piston cooling system in a conventional internal combustion engine, there is known a construction in which a cooling oil flow path is formed which communicates with an oil passage which is provided in an internal combustion engine and a nozzle portion is provided on a back side of a piston so that oil is jetted from the nozzle portion.

In this related art, as described in JP-A-2004-124938, for example, there is a construction in which a member which is referred to as an end piece is fitted on a distal end of an outlet pipe (a nozzle portion) which is a pipe member as a member different from the pipe member. In this construction, oil is jetted towards a back side of a piston from a plurality of holes provided in the end piece.

In the construction described in JP-A-2004-124938, however, the end piece is attached externally to the outlet pipe (the nozzle portion) of the pipe member in such a manner that the end piece is fitted on the outlet pipe so as to cover the distal end thereof. Consequently, it is necessary that the end piece is, for example, press fitted in the outlet pipe, or welded or bonded thereto in order to fix the end piece in place. Here, when the end piece is fixed to the outlet pipe through bonding, a bonding facility as well as an adhesive is necessary. In this way, in the fixing method based on welding or bonding, not only is the production facility necessary to be enlarged, but also the production process becomes complicated, leading to a problem that the production costs are increased.

On the other hand, when the end piece is fixed through press fitting, the end piece is pushed into the distal end of the outlet pipe so that the end piece is held therein only with a fastening force exerted in a radial direction of the outlet pipe. However, since an oil pressure to be exerted on the end piece is exerted in an axial direction of the outlet pipe, a press-fit amount at the press-fit portion needs to be large, leading to a problem that the fixing construction is enlarged. Further, in the case of the press-fitting method being adopted, since there is also a possibility that the press-fit portion is loosened by the vibration of the internal combustion engine, the fixing construction needs to be enlarged more to avoid the possible loosening of the press-fit portion in the current situations.

SUMMARY

The invention has been made in view of these situations, and an object thereof is to provide a piston cooling system which is strong against external vibrations and further which can withstand sufficiently an oil pressure exerted thereon with a fixing construction which is simple and not large without enlarging the production facility and complicating the production process.

With a view to achieving the object, according to a first aspect of the invention, there is provided a piston cooling system having a nozzle pipe portion which communicates with an oil passage which is provided in an internal combustion engine and which extends towards an interior of a cylinder bore and a flow path forming member which is fixed to a distal end portion of the nozzle pipe portion and in which a plurality of oil jetting paths are formed to thereby cool a piston within the cylinder bore by jetting oil from the oil jetting paths towards a back side of the piston, wherein the from distal end portion includes an expanded pipe portion where the nozzle pipe portion is expanded and the flow path forming member is fittingly inserted into the expanded pipe portion, wherein the flow path forming member has a distal end face which is exposed to an exterior portion at a distal end side thereof, and wherein the flow path forming member is locked in the expanded pipe portion by deforming a distal end edge of the expanded pipe portion so as to provide a locking portion which locks the distal end face of the flow path forming member.

According to a second aspect of the invention, there is provided the piston cooling system according to the first aspect, wherein the distal end edge of the expanded pipe portion projects further towards the distal end side of the expanded pipe portion than the distal end face of the flow path forming member in such a state that the flow path forming member is inserted into the expanded pipe portion.

According to a third aspect of the invention, there is provided the piston cooling system according to the first or second aspect, wherein the expanded pipe portion has a tapered inner circumferential wall surface which is formed so as to gradually expand towards the distal end edge, wherein the flow path forming member has a tapered outer circumferential wall surface which corresponds to the inner circumferential wall surface and groove portions are formed in the outer circumferential wall surface, and wherein the oil jetting paths are formed by the inner circumferential wall surface and the groove portions.

According to a fourth aspect of the invention, there is provided the piston cooling system according to any of the first to third aspects, wherein the flow path forming member is formed from a synthetic resin.

According to a fifth aspect of the invention, there is provided the piston cooling system according to the third or fourth aspect, wherein the nozzle pipe portion is formed of a metal, and a tapered angle of the inner circumferential wall surface of the expanded pipe portion is less than 30 degrees with respect to an axis of the nozzle pipe portion.

According to a sixth aspect of the invention, there is provided the piston cooling system according to any of the first to fifth aspects, wherein the flow path forming member is locked in the expanded pipe portion by the locking portion which is provided at a circumferential portion on the distal end edge, and the locking portion is positioned to deviate from the oil jetting paths in a circumferential direction of the distal end edge.

According to a seventh aspect of the invention, there is provided the piston cooling system according to any of the first to sixth aspects, wherein a spark plug and an exhaust port face a combustion chamber which is defined by the cylinder bore and the piston, and the oil jetting paths include at least a first oil jetting path which jets oil towards a close-to-spark-plug portion on the back side of the piston and a second oil jetting path which jets oil towards a close-to-exhaust-port portion on the back side of the piston.

According to an eighth aspect of the invention, there is provided the piston cooling system according to any of the third to seventh aspects, wherein a rotation restricting portion which restricts a rotational movement of the flow path forming member around an axis of the expanded pipe portion is formed between the inner circumferential wall surface of the expanded pipe portion and the outer circumferential wall surface of the flow path forming member.

According to a ninth aspect of the invention, there is provided the piston cooling system according to any of the first to seventh aspects, wherein an identification portion which identifies a fittingly inserting orientation of the flow path forming member around the axis of the expanded pipe portion is provided on the distal end face so as to be depressed thereinto or project therefrom.

According to a tenth aspect of the invention, there is provided the piston cooling system according to any of the first to ninth aspects, wherein the locking portion on the distal end edge is formed through at least either crimping or bending.

According to the first aspect of the invention, the holding construction is provided in which the expanded pipe portion is formed at the distal end portion of the nozzle pipe portion and the flow path forming member is inserted into the expanded pipe portion, whereby the flow path faulting member is locked in the expanded pipe portion by the locking portion which locks the distal end face of the flow path forming member by deforming the distal end edge of the expanded pipe portion. Therefore, in fixing the separate flow path forming member to the distal end portion, welding or bonding becomes unnecessary, thereby making it possible not only to simplify the production process of the piston cooling system but also to realize a reduction in production costs thereof. Further, according to the construction in which the distal end face of the flow path forming member is locked by the locking portion, the flow path forming member is locked in such a way as to be caught in the direction which intersects the oil jetting direction by the locking portion, and therefore, the flow path forming member can be held strongly and rigidly against the pressure exerted on the flow path forming member in the direction of the axis of the expanded pipe portion by the oil pressure or external force such as vibrations of the internal combustion engine. Additionally, the holding construction by the locking portion is the simple construction which is made by deforming the distal end edge of the expanded pipe portion, and therefore, the enlargement of the piston cooling system is avoided.

According to the second aspect of the invention, there is provided the construction in which the distal end edge of the expanded pipe portion projects further towards the distal end side than the distal end face of the flow path forming member in such a state that the flow path forming member is inserted into the expanded pipe portion. Therefore, since the sufficient locking amount is ensured in locking the flow path forming member, it is possible to form the strong and rigid locking portion easily, whereby it is possible to make the holding force of the flow path forming member strong.

According to the third aspect of the invention, the oil jetting paths are formed by the inner circumferential wall surface of the expanded pipe portion which is gradually expanded into the tapered shape and the groove portions in the outer circumferential wall surface of the flow path forming member. Therefore, the oil jetting angle of the oil jetting paths can be set to the desired angle based on the inclination angle of the tapered shape. Consequently, the oil jetting angle is set extremely easily only by fittingly inserting the flow path forming member into the expanded pipe portion so that oil can be jetted in the desired direction. Thus, compared with, for example, a case where oil jetting paths are formed through drilling, the oil jetting angle can be set extremely easily, thereby making it possible to enhance the productivity remarkably. Further, when the plurality of oil jetting paths are formed, the number of times of drilling can be reduced, whereby the enhancement in productivity becomes remarkable.

According to the fourth aspect of the invention, by forming the flow path forming member from the synthetic resin, the formation of the groove portions which make up the oil jetting paths and the formation of the outer circumferential wall surface which corresponds to the tapered shape of the expanded pipe portion can be facilitated, whereby the superior productivity can be obtained.

According to the fifth aspect of the invention, the tapered angle of the inner circumferential wall surface is set to be less than 30 degrees, whereby crazing or cracking is made difficult to occur around the expanded pipe portion in expanding the nozzle pipe portion. Additionally, since the expanded pipe portion is formed by forcing the metallic nozzle pipe portion out of the shape, the oil jetting direction can be set to the desired value as required to thereby enhance the degree of freedom, thereby making it possible to enhance the versatility (the adaptability to the construction of the cylinder bore or the like).

According to the sixth aspect of the invention, the locking portion is provided only at the circumferential portion of the distal end edge of the expanded end edge, and the locking portion is positioned so as to deviate from the oil jetting paths in the circumferential direction of the distal end edge. Therefore, it is possible to avoid the interference of the locking portion with the oil jetting paths. Additionally, it is also possible to ensure the degree of freedom in setting the oil jetting direction by setting the positions of the oil jetting paths in advance and then providing the locking portion so as to avoid the positions of the oil jetting paths.

According to the seventh aspect of the invention, by providing the first jetting path and the second jetting path which jet oil so as to cool positively heat spots which range from the circumference of the spark plug to the circumference of the exhaust port where the temperature is particularly increased, the cooling efficiency can be enhanced to prevent the improper combustion (knocking) and the improvement in the output of the internal combustion engine and the fuel economy can be achieved. Further, since the peripheries of the heat spots are cooled by jetting oil from the lower side of the cylinder bore by the plurality of oil jetting paths, it is possible to eliminate a risk of the jetted oil being interrupted completely by a connecting rod or the like. Thus, since the continuous oil jetting towards the peripheries of the heat spots can be maintained, it is possible to avoid a situation in which the back side of the piston is not cooled, thereby making it possible to cool the peripheries of the heat spots efficiently. Additionally, since the heat spots are aimed at positively in jetting oil, even with a small amount of oil jetted, the heat spots can be cooled efficiently, thereby making it possible to realize a reduction in size of the oil pump.

According to the eighth aspect of the invention, the rotation restricting portion which restricts the rotational movement of the flow path forming member around the axis of the expanded pipe portion is formed on the flow path forming member, whereby it is possible to determine the installing orientation of the flow path forming member when the flow path forming member is installed in the inner circumferential wall surface of the expanded pipe portion, as a result of which it also becomes extremely easy to set the oil jetting direction to the desired direction. Consequently, the respective jetting directions of the plurality of oil jetting paths can be set with good accuracy only by installing and fixing in place the flow path forming member in which the oil jet paths are formed, thereby making it possible to execute the piston cooling with good efficiency.

According to the ninth aspect of the invention, the installing orientation of the flow path forming member around the axis of the expanded pipe portion can be identified when fittingly inserting the flow path forming member in the expanded pipe portion, whereby the installing orientation of the flow path forming member can easily be set, which makes it extremely easy to set the oil jetting direction to the desired direction. In particular, since the identification portion is provided on the distal end face of the flow path forming member, the identification portion can easily be visualized from the outside, so that the identification portion can easily be made use of to identify the inserting orientation of the flow path forming member. In particular, when the flow path forming member in which the plurality of oil jetting paths are formed is installed, the respective oil jetting directions of the oil jetting paths can be set with good accuracy, whereby it is possible to execute the piston cooling with good efficiency.

According to the tenth aspect of the invention, the locking portion at the distal end edge is formed through at least either crimping or bending, and therefore, the crimping or bending can be executed after the expanded pipe portion is formed at the distal end portion of the nozzle pipe portion and the flow path forming member is inserted into the expanded pipe portion, whereby the holding construction of the flow path forming member can be simplified, thereby making it possible to realize a reduction in production costs. Further, the locking portion which is formed by crimping or bending the distal end edge of the distal end portion can exhibit effectively the locking force in the direction which intersects the oil jetting direction. Consequently, the holding force with which the flow path forming member is held can be made strong against the oil pressure exerted on the flow path forming member in the direction of the axis of the expanded pipe portion or the external force such as vibrations of the internal combustion engine.

BRIEF DESCRIPTION OF THE DRAWINGS

The present invention will become more fully understood from the detailed description given hereinbelow and the accompanying drawing which is given by way of illustration only, and thus is not limitative of the present invention and wherein:

FIGS. 10A and 10B show perspective views showing modified examples of the flow path forming member of the second embodiment, in which FIG. 10A is a perspective view showing a case where an identification portion takes the form of an elongated groove, and FIG. 10B. is a perspective view showing a case where the identification portion takes the form of an elongated projection;

DETAILED DESCRIPTION OF THE INVENTION

Figure 1:
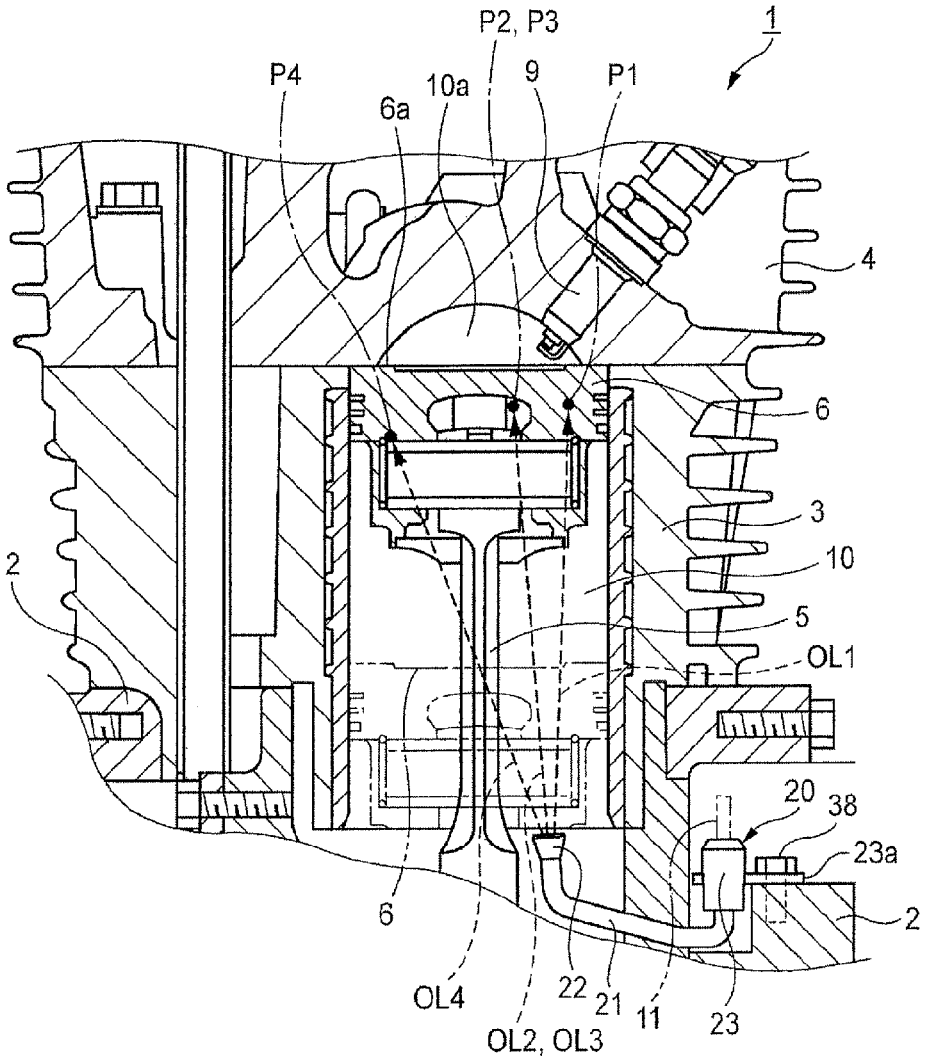
FIG. 1 is a sectional view of a main part of an internal combustion engine of a first embodiment as seen from a direction which intersects an axis of a crankshaft at right angles.

Hereinafter, embodiments of the invention will be described by reference to the accompanying drawings.

(First Embodiment)

A first embodiment of the invention will be described in detail by reference to FIGS. 1 to 8. It is noted that when vertical or laterally horizontal directions or orientations are mentioned in the specification, such directions or orientations are meant that result when the accompanying drawings are seen in such a way that given reference numerals or characters look properly oriented.

Figure 2:
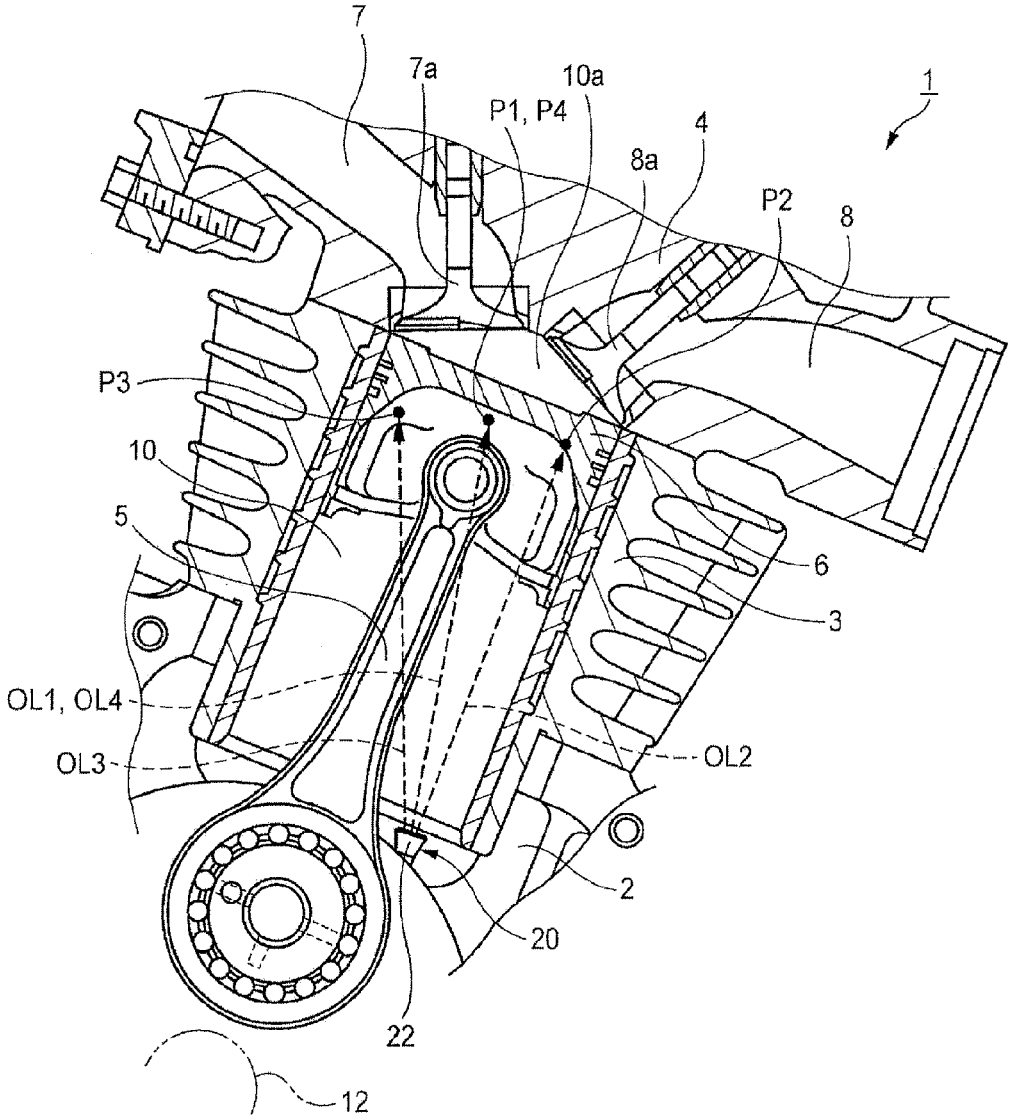
FIG. 2 is a sectional view of the main part of the internal combustion engine of the first embodiment as seen in an axial direction of the crankshaft.
Figure 3:
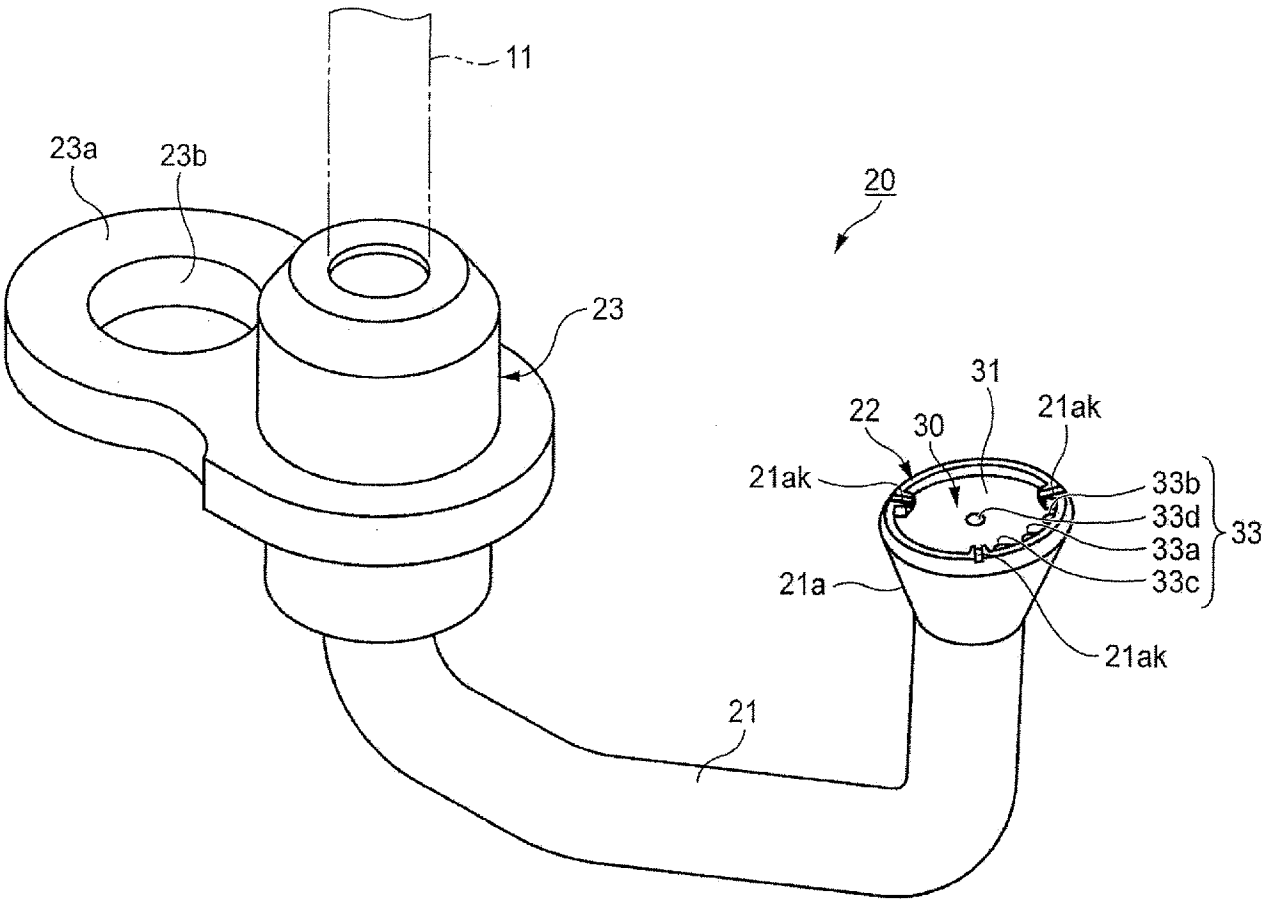
FIG. 3 is a perspective view showing a cooling system for a piston shown in FIG. 1.
Figure 4:
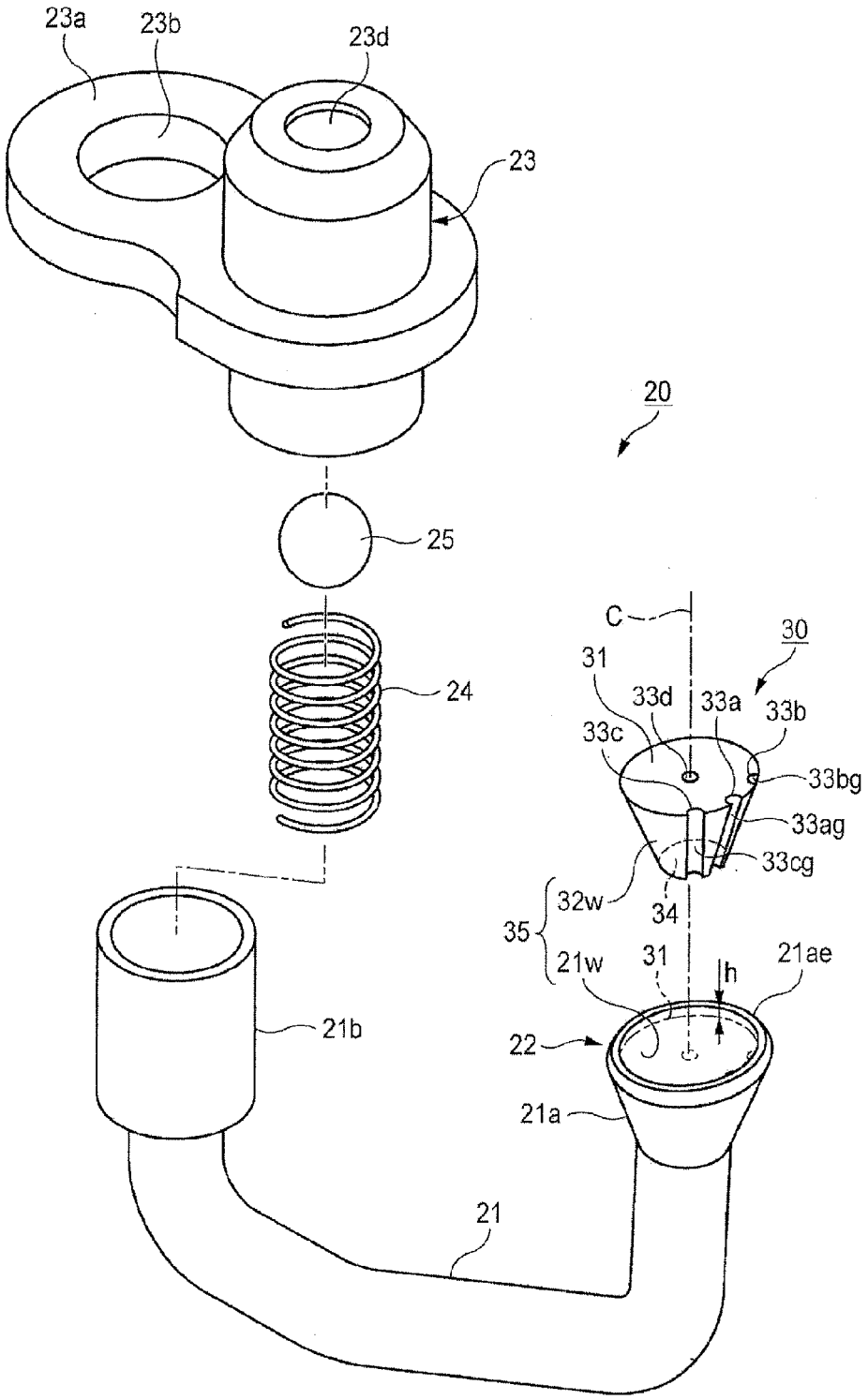
FIG. 4 is an exploded perspective view of the cooling system shown in FIG. 3.
Figure 5:
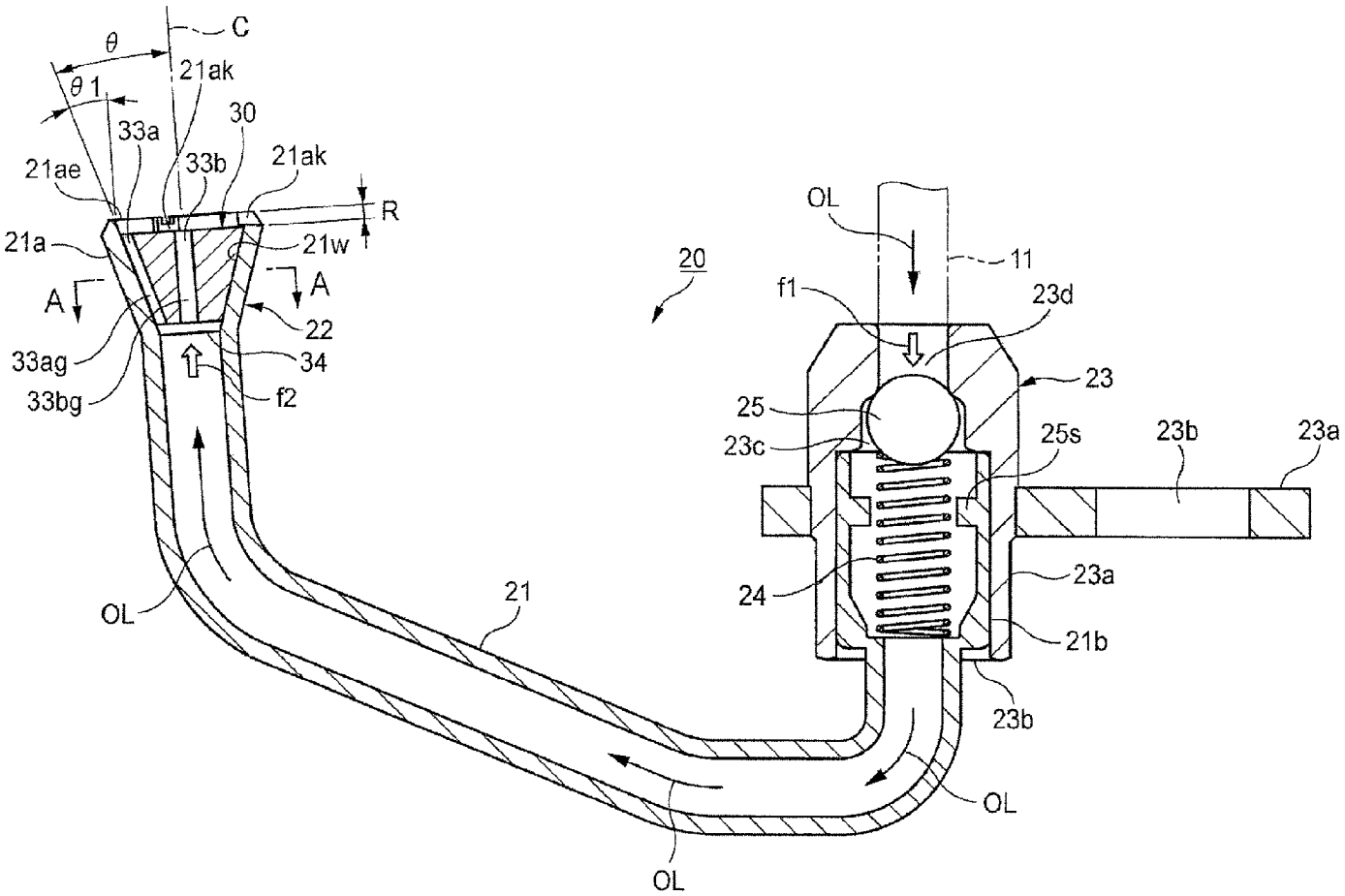
FIG. 5 is a sectional view of the cooling system shown in FIG. 3.
Figure 6:
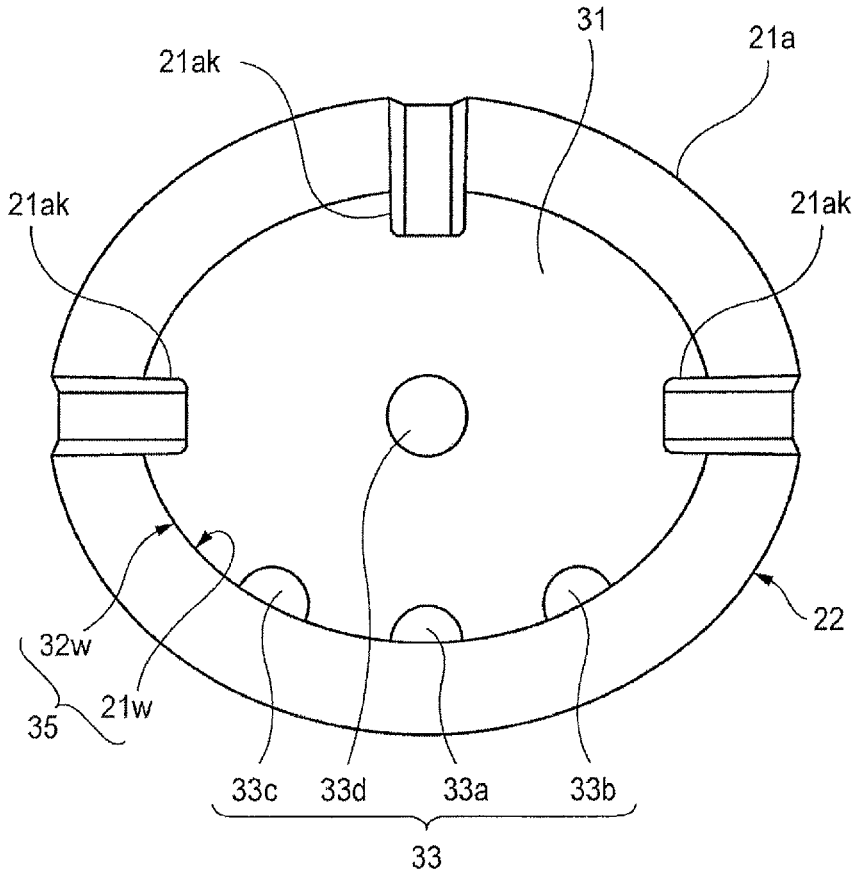
FIG. 6 is a plan view of a distal end portion of the cooling system shown in FIG. 3 as viewed thereabove.
Figure 7:
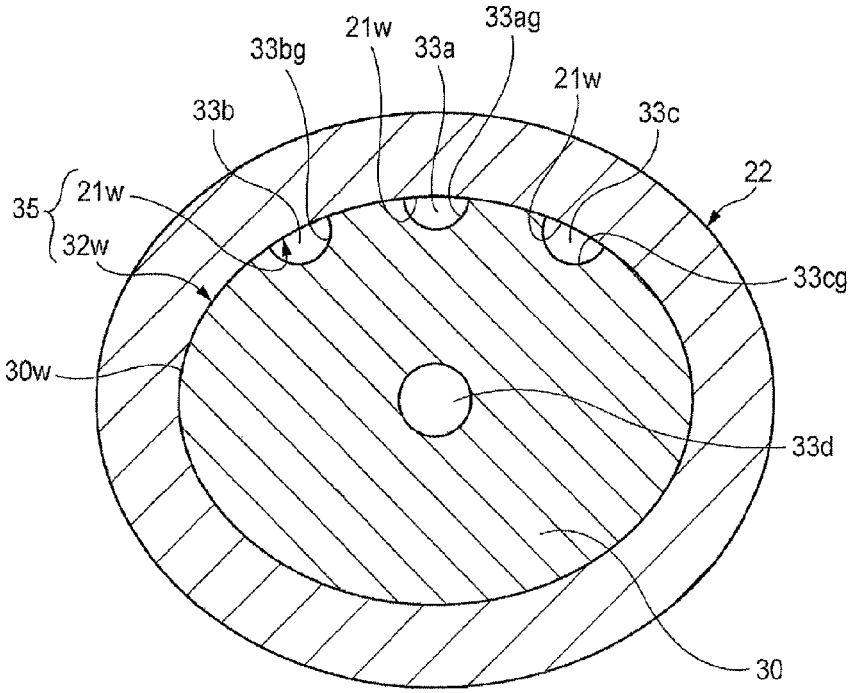
FIG. 7 is a sectional view of the distal end portion taken along the line A-A in FIG. 5.
Figure 8:
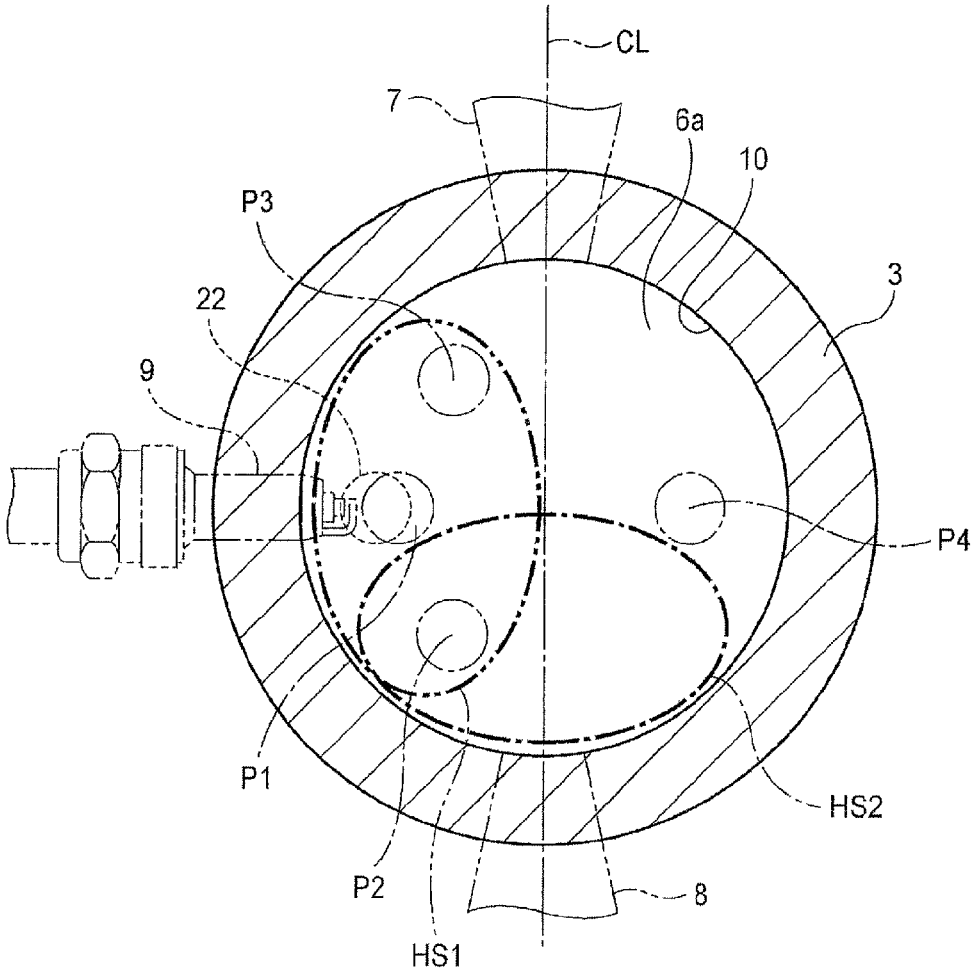
FIG. 8 is a schematic plan view showing cooling locations when a cylinder bore and a piston head portion of the first embodiment are seen in a vertical direction.

This embodiment describes specifically a cooling system for a piston of an internal combustion engine which is applied to a motorcycle as a riding type vehicle. FIG. 1 is a sectional view of a main part of an internal combustion engine 1 of the first embodiment as seen in a direction which intersects an axis of a crankshaft at right angles. FIG. 2 is a sectional view of the main part of the internal combustion engine 1 of the first embodiment as seen in the direction of the axis of the crankshaft. FIG. 3 is a perspective view of the piston cooling system shown in FIG. 1, and FIG. 4 is an exploded perspective view of the cooling system shown in FIG. 3. Further, FIG. 5 is a sectional view of a main part of the cooling system shown in FIG. 3. Additionally, FIG. 6 is a plan view of a distal end portion of the cooling system shown in FIG. 3 as seen from thereabove, and FIG. 7 is a sectional view of a portion taken along the line A-A in FIG. 5. In addition, FIG. 8 is a schematic plan view which shows explanatorily cooling locations when a cylinder bore and a piston head portion are seen in a vertical direction.

In the internal combustion engine 1 of this embodiment, as shown in FIGS. 1 and 2, a cylinder bore 10 is defined by a cylinder 3 which is provided to extend upwards from a crankcase 2 and a cylinder head 4. Then, a connecting rod 5 which is connected to a crankshaft 12 is connected to a rear side of a piston 6 which moves vertically within the cylinder bore 10.

In addition, as shown in FIG. 2, an intake port 7 and an exhaust port 8 are made to communicate with a combustion chamber 10*a* which is surrounded by an upper surface of the piston 6 and the cylinder bore 10, and an induction stroke and an exhaust stroke are executed at appropriate timings of a combustion cycle by an intake valve 7*a* and an exhaust valve 8*a* which are opened and closed as required.

A cooling system 20 for the piston 6 of this embodiment is provided at a lower portion of the cylinder bore 10. The cooling system 20 communicates with an oil passage 11 which is provided in the internal combustion engine 1 as shown in FIG. 1 and includes a nozzle pipe portion 21 which extends towards an interior of the cylinder bore 10, a flow path forming member 30 which forms a plurality of oil jetting paths 33 (refer to FIG. 3) in a distal end portion 22 of the nozzle pipe portion 21, a nozzle fixing portion 23 which is fixed to an external side of the crankcase 2, a fixing flange 23 and the like. The oil jetting paths 33 of this embodiment include a total of four oil jetting paths which are formed in the distal end portion 22 so as to open upwards towards the interior of the cylinder bore 10: they are, as shown in FIG. 3, a first oil jetting path 33*a*, a second oil jetting path 33*b* and a third oil jetting path 33*c* which are formed along an outer circumferential edge of a distal end face 31 and a fourth oil jetting path 33*d* which is formed substantially in the center of the distal end face 31. Then, oil OL supplied from an oil pump, not shown, is jetted from the first to fourth oil jetting paths 33*a*, 33*b*, 33*c*, 33*d* towards a back of the piston 6 so that the oil OL (OL1 to OL4) is sprayed directly to the back of the piston 6 which faces the combustion chamber 10*a* for effective cooling. The cooling of the piston 6 by the oil OL jetted from the first to fourth oil jetting paths 33*a*, 33*b* 33*c*, 33*d* will be described in detail later.

The cooling system 20 of this embodiment has the nozzle pipe portion 21 which is formed substantially into a U shape as shown in FIGS. 4 and 5. An expanded pipe portion 21*a* at the distal end portion 22, which is one end portion, of the nozzle pipe portion 21 faces the interior of the cylinder bore 10, while a proximal end portion 21*b*, which is the other end portion, of the nozzle pipe portion 21 is fittingly inserted in the nozzle fixing portion 23 which is disposed on the external side of the crankcase 2.

The expanded pipe portion 21*a* of the distal end portion 22 has a substantially inverted frustum of circular cone construction in which the nozzle pipe portion 21 is gradually expanded towards a distal end side thereof. Additionally, the flow path forming member 30 is inserted in the expanded pipe portion 21*a*, and this flow path forming member 30 has a substantially inverted frustum of circular cone shape which matches an inner surface shape of the expanded pipe portion 21*a*. Then, with the flow path forming member 30 so inserted, as shown in FIG. 6, a distal end edge 21*ae* of the expanded pipe portion 21*a* is crimped partially through crimping so as to form locking portions 21*ak*. This enables the flow path forming member 30 to be locked and held in the expanded pipe portion 21*a*.

Additionally, as described above, a tapered inner circumferential wall surface 21*w* which is gradually expanded diametrically as it extends towards the distal end edge 21*ae* is formed in the expanded pipe portion 21*a*. On the other hand, a tapered outer circumferential wall surface 32*w* which corresponds to the inner circumferential wall surface 21*w* is formed on the flow path forming member 30. Further, groove portions 33*ag*, 33*bg*, 33*cg* are formed in the outer circumferential wall surface 32*w* so as to extend along the direction of an axis of the expanded pipe portion 21*a*. By adopting this configuration, when the flow path forming member 30 is inserted into the expanded pipe portion 21*a*, the oil jetting paths 33*a*, 33*b*, 33*c* are formed by the inner circumferential wall surface 21*w* and the groove portions 33*ag*, 33*bg*, 33*cg*, as shown in FIG. 7. It is noted that the fourth oil jetting path 33*d* is formed in the flow path forming member 30.

The proximal end portion 21*h* is expanded diametrically more than a central portion of the nozzle pipe portion 21. A compression spring 24 is installed in the diametrically expanded portion, and a check ball 25 is accommodated in a ball accommodating portion 23*c* in such a state that the check ball 25 is biased upwards by the compression spring 24. Additionally, a stopper 25*s* which restricts a traveling amount of the check bass 25 is formed integrally on an inner circumference of the proximal end portion 21*b*. Consequently, this check ball 25 is biased so as to close a communication hole 23*d*, and when an oil pressure f1 from the oil passage 11 reaches or exceeds a certain level, the check ball 25 opens the communication hole 23*d* to supply the oil OL to an interior of the nozzle pipe portion 21. In addition, the fixing flange 23*a* is provided on the nozzle fixing portion 23 so as to extend in a radial direction of the nozzle fixing portion 23, and a mounting hole 23*b* is provided in the fixing flange 23*a*. Consequently, the cooling system 20 is fixed to the crankcase 2 via a bolt 38 (refer to FIG. 1) which is inserted through the mounting hole 23*b*.

In this way, in this embodiment, the expanded pipe portion 21*a* is formed at the distal end portion 22 of the nozzle pipe portion 21, and the flow path forming member 30 is inserted into the interior of the expanded pipe portion 21*a*. Further, the holding construction is provided in which the flow path forming member 30 is locked firmly in the interior of the expanded pipe portion 21*a* by crimping the distal end edge 21*ae* of the expanded pipe portion 21*a*. Consequently, welding or bonding does not have to be executed in fixing the flow path forming member 30 to the distal end portion 22, the production process of the cooling system 20 for cooling the piston 6 can be simplified.

Further, according to the construction in which the distal end edge 21*ae* of the distal end portion 22 is crimped, the flow path forming member 30 can be locked in such a way that the distal end face 31 thereof is caught in a direction which intersects the oil jetting direction by the locking portions 21*ak*. Consequently, as shown in FIG. 5, the flow path forming member 30 can be restrained firmly from moving to be dislocated in the oil jetting direction by a pressure f2 which presses the flow path forming member 30 in the oil jetting direction. In addition, the flow path forming member 30 can also be held strongly and rigidly against external forces such as vibrations of the internal combustion engine 1 which are exerted on the flow path forming member 30. Moreover, the holding construction of this embodiment which is based on crimping is the simple construction, and therefore, the enlargement of the piston cooling system 20 is avoided.

In the production process of the cooling system 20 of this embodiment, when the flow path forming member 30 is inserted into the expanded pipe portion 21*a*, as shown in FIG. 4, the distal end edge 21*ae* of the expanded pipe portion 21*a* projects by a predetermined dimension (h) further towards the distal end side of the expanded pipe portion 21*a* than the distal end face 31 of the flow path forming member 30. In this way, by adopting the construction in which the distal end edge 21*ae* of the expanded pipe portion 21*a* projects further towards the distal end side than the distal end face 31 of the flow path forming member 30, a crimping amount of the distal end edge 21*ae* is ensured. Consequently, it is extremely easy to form the locking portions 21*ak* by crimping part of the distal end edge 21*ae* radially inwards of the distal end portion 22 as shown in FIGS. 3 and 6. In addition, in this embodiment, the locking portions 21*ak* are formed based on the sufficient crimping amount which is ensured from the beginning, and therefore, the thickness of the crimped portions can be increased so as to ensure a sufficient strength, thereby making it possible to hold the flow path forming member 30 with a strong force.

In this embodiment, the oil jetting paths 33*a*, 33*b*, 33*c* are formed by the inner circumferential wall surface 21*w* of the expanded pipe portion 21*a* which is gradually expanded into the tapered shape and the groove portions 33*ag*, 33*bg*, 33*cg* on the outer circumferential wall surface 30*w* of the flow path forming member, and therefore, for example, as shown in FIG. 5, an oil jetting angle θ1 can be set to a desired angle by an inclination angle of the tapered shape. In this way, the oil jetting angle θ1 can be set extremely easily only by fittingly inserting the flow path forming member 30 into the expanded pipe portion 21*a*. For example, compared with a case where the oil jetting paths 33 are drilled, according to the configuration of this embodiment, the oil jetting angle θ1 can be set extremely easily, thereby making it possible to enhance the productivity remarkably. Further, in the case of the plurality of oil jetting paths 33 being provided, the number of times of drilling the oil jetting paths 33 can be reduced, which is extremely good to enhance the productivity.

In this embodiment, the flow path forming member 30 can be formed from a resin such as a polyamide based resin PATS or the like, for example. Consequently, when the flow path forming member 30 is formed, the groove portions 33*ag*, 33*bg*, 33*cg* which make up the oil jetting paths 33*a*, 33*b*, 33*c*, respectively, and the oil jetting path 33*d* can easily be formed. Additionally, the tapered construction of the outer circumferential wall surface 30*w* can also be formed easily, whereby a superior productivity can be provided by this embodiment. It is noted that the material of the flow path forming member 30 is not limited to the polyamide based resin material, and hence, a nylon based resin or a forged metal may be used for the flow path forming member 30.

In this embodiment, the nozzle pipe portion 21 which accommodates the flow path forming member 30 is formed of a metal such as a carbon steel pipe of, for example, SWCH, TKM or the like. Additionally, a tapered angle θ of the inner circumferential wall surface 21*w* of the expanded pipe portion 21*a* is less than 30 degrees with respect to an axis C of the nozzle pipe portion 21. Here, in the event that the tapered angle θ of the inner circumferential wall surface 21*w* of the expanded pipe portion 21*a* is less than 30 degrees with respect to the axis C of the nozzle pipe portion 21, a pipe expanding angle is not increased too largely when expanding the nozzle pipe portion 21, whereby a deformation load is restrained from being exerted to the circumference of the expanded pipe portion 21*a*. Consequently, a desired working operation can be executed without producing crazing or cracking on the circumference of the expanded pipe portion 21*a*. Additionally, the expanded pipe portion 21*a* is formed by forcing the metallic nozzle pipe portion 21 out of the shape to be expanded diametrically, and therefore, the angle of the oil jetting direction can be set to a desired value, and the degree of freedom in setting the angle of the oil jetting direction is high, thereby making it possible to improve the versatility of the cooling system.

In this embodiment, the flow path forming member 30 is locked so as not to be dislocated from the expanded pipe portion 21*a* by the locking portions 21*ak* which are formed by crimping part of the distal end edge 21*ae* of the expanded pipe portion 21*a* so as to project towards a central portion of the distal end face 31. In addition, the locking portions 21*ak* are formed in three locations which deviate from the oil jetting paths 33*a*, 33*b*, 33*c*, as shown in FIGS. 3 and 6.

In this way, the locking portions 21*ak* are formed along the distal end edge 21*ae* in the positions which deviate from the oil jetting paths 33*a*, 33*b*, 33*c*, and therefore, the locking portions 21*ak* do not interfere with the oil jetting paths 33*a*, 33*b*, 33*c*. Additionally, when forming the locking portions 21*ak*, the oil jetting paths 33*a*, 33*b*, 33*c* are positioned, whereafter the locking portions 21*ak* are provided so as to avoid the oil jetting paths 33*a*, 33*b*, 33*c*, and therefore, the degree of freedom in setting the oil jetting direction can be ensured.

The overall shape of the flow path forming member 30 of this embodiment is the substantially inverted frustum of circular cone shape as shown in FIG. 4. However, the distal end face 31 has an elliptic shape as shown in FIG. 6, and a lower end face 34 has a circular shape. On the other hand, the inner circumferential wall surface 21*w* of the expanded pipe portion 21*a* is worked so as to have the shape which coincides with the outer circumferential wall surface 32*w* of the flow path forming member 30 as described above. In this way, by forming the distal end face 31 into the elliptic shape, the flow path forming member 30 is allowed to have a non-circular cross-sectional shape, which prohibits the flow path forming member 30 to rotate within the expanded pipe portion 21*a*. Consequently, a rotation restricting portion 35 which restricts the rotation of the flow path fainting member 30 and identifies the installing orientation of the flow path forming member 30 is formed by the inner circumferential wall surface 21*w* of the expanded pipe portion 21*a* and the outer circumferential surface 32*w* of the flow path forming member 30.

In this way, when the rotation restricting portion 35 is formed which has a rotation restricting function to restrict the rotation of the flow path footling member 30, it becomes easy to set the installing orientation of the flow path forming member 30 properly when the flow path forming member 30 is fittingly inserted into the expanded pipe portion 21*a*. Namely, when the flow path forming member 30 is fittingly inserted into the expanded pipe portion 21*a*, in order to set the installing orientation (the orientation in the circumferential direction around the axis C) of the flow path forming member 30, the rotation restricting portion 35 can be made use of, for example, to identify the orientation of the flow path forming member 30 from the elliptic shape of the end face 31 by the use of an image recognition device to control the movement of a chucking device in an installing step so as to install the flow path forming member 30 in the expanded pipe portion 21*a* by setting the installing orientation of the flow path forming member 30 to the desired direction by the chucking device.

The timing at which the orientation of the flow path forming member 30 is identified is when the flow path forming member 30 is chucked or after the flow path forming member 30 is chucked. Additionally, in controlling the orientation of the flow path forming member 30 when it is fittingly inserted into the expanded pipe portion 21*a* from the chucked state, in case the flow path forming member 30 is oriented to some extent, for example, only by causing the flow path forming member 30 to fall into the expanded pipe portion 21*a*, the flow path forming member 30 can advantageously be installed in the expanded pipe portion 21*a* with good accuracy. Namely, in this embodiment, the extremely accurate installation of the flow path forming member 30 in the expanded pipe portion 21*a* can be executed by making use of the configuration in which the flow path forming member 30 and the expanded pipe portion 21*a* have the same circumferential wall surface configurations without accurately aligning the flow path forming member 30 with the expanded pipe portion 21*a* by the use of the image recognition device or the like.

In this way, in the flow path forming member 30 of this embodiment, by providing the rotation restricting portion 35 which restricts the rotational movement of the flow path forming member 30 around the axis C of the expanded pipe portion 21*a*, when the flow path forming member 30 is installed in the inner circumferential wall surface 21*w* of the expanded pipe portion 21*a*, the installing orientation of the flow path forming member 30 can be determined by fittingly inserting the flow path forming member 30 into the expanded pipe portion 21*a*, and the oil jetting direction can also be set easily to the desired direction. Consequently, in particular, when the flow path forming member 30 in which the plurality of oil jetting paths 33*a*, 33*b*, 33*c*, 33*d* are formed is installed in the expanded pipe portion 21*a*, the respective jetting directions of the oil jetting paths 33*a*, 33*b*, 33*c*, 33*d* can be set with good accuracy as will be described later, whereby the piston can be cooled with good efficiency.

Hereinafter, referring to FIGS. 1, 2 and 8, the cooling of the piston 6 according to this embodiment will be described in detail. FIG. 8 shows the schematic plan view depicting the cooling locations when the cylinder bore and the piston head portion are seen from a vertical direction. Additionally, in FIG. 8, since positions to which the oil OL is jetted deviate in association with the vertical movement of the piston 6, cooling points P to which the oil OL is sprayed are shown as circular shapes as a matter of convenience.

The four oil jetting paths, that is, the first oil jetting path 33*a*, the second oil jetting path 33*b*, the third oil jetting path 33*c* and the fourth oil jetting path 33*d* are set to jet the oil OL towards four cooling points P (P1, P2, P3, P4) in a one-to-one corresponding fashion when the cylinder bore 10 is seen from the vertical direction as shown in FIG. 8. Specifically, the oil jetting paths 33 which correspond individually to the four cooling points P are set so that the first oil jetting path 33*a* corresponds to a close-to-spark-plug location P1 which lies close to the spark plug 9 which is easiest to be heated to a high temperature, the second oil jetting path 33*b* corresponds to a close-to-exhaust-port location P2 which lies close to the exhaust port 8 through which heated gas passes and which is relatively easier to be heated to a high temperature, the third oil jetting path 33*c* corresponds to a close-to-intake-port location P3 which lies close to the intake port 7 which is relatively easier to be heated to a high temperature since it lies near the spark plug 9 although an unburned air-fuel mixture enters it, and the fourth oil jetting path 33*d* corresponds to a distant-from-spark plug location P4 which lies most distant from the spark plug 9 and which is relatively more difficult to be heated to a high temperature than the other locations.

Oil streams OL1, OL2, OL3, OL4 jetted from the individual oil jetting paths 33 are jetted from the distal end portion 22 towards the cooling points P (P1, P2, P3, P4) on the back of the piston 6 at predetermined angles, as shown in FIGS. 1 and 2.

In this way, in this embodiment, as shown in FIG. 8, the three cooling points P (P1, P2, P3) are provided substantially in a half area (a left-hand side half area in FIG. 8), lying close to (near) the spark plug 9, of half areas of the cylinder bore 10 which are divided by an imaginary center line CL on which the exhaust port 8 and the intake port 7 are arranged. On the other hand, only the cooling point P (P4) is provided substantially in the half area (the right-hand side half area in FIG. 8) which lies distant from the spark plug 9. Additionally, the cooling point P (P2) is provided in an area HS2 (schematically shown on a lower side in FIG. 8 as an elliptic shape as a matter of convenience) which lies close to (near) the exhaust port 8.

In this way, in this embodiment, the first oil jetting path 33*a*, the second oil jetting path 33*b* and the third jetting path 33*c* are provided to cool positively a heat spot HS1 (schematically shown as an elliptic shape as a matter of convenience on the left-hand side in FIG. 8) which ranges from the periphery of the spark plug 9 which is specifically heated to a high temperature to the periphery of the exhaust port 8, whereby the piston 6 can be cooled effectively. Further, the fourth oil jetting path 33*d* is provided to cool the whole of the piston 6 uniformly. Consequently, according to the cooling system 20 of this embodiment, it is possible not only to prevent the improper combustion (knocking) by increasing the cooling efficiency but also to achieve an improvement in fuel economy as well as an increase in output of the internal combustion engine.

Further, in this embodiment, the distal end portion 22 of the cooling system 20 is disposed on the side of the cylinder bore 10 where the heat spots HS are formed when the cylinder bore 10 is seen from thereabove, and therefore, the oil is normally jetted to the cooling points P1, P2, P3 without being interrupted by the connecting rod 5, whereby the heat spots HS are cooled effectively.

In this way, since the oil is jetted from the lower side of the cylinder bore 10 by the plurality of oil jetting paths 33, in this embodiment, although a situation occurs in which the oil stream OL4 jetted from the fourth oil jetting path 33*d* is interrupted by the connecting rod 5, there is no such situation that the jetted oil streams are completely interrupted by the connecting rod 5 at the same time, whereby a situation can be avoided in which no oil is supplied to the back side of the piston 6, thereby making it possible to cool the piston 6 effectively.

(Second Embodiment)

Hereinafter, a second embodiment of the invention will be described by reference to FIGS. 9, 10A and 10B.

In the second embodiment, the illustration and description of constructions like to those described in the first embodiment will be omitted, and only constructions which are different from those of the first embodiment and peripheral constructions thereof will be illustrated. Additionally, like reference numerals will be given to like constituent elements to those of the first embodiment. FIG. 9 is a perspective view of a nozzle pipe portion and a flow path forming member of a cooling system of the second embodiment, and FIGS. 10A and 10B show perspective views depicting modified examples made to the flow path forming member of the second embodiment.

Figure 9:
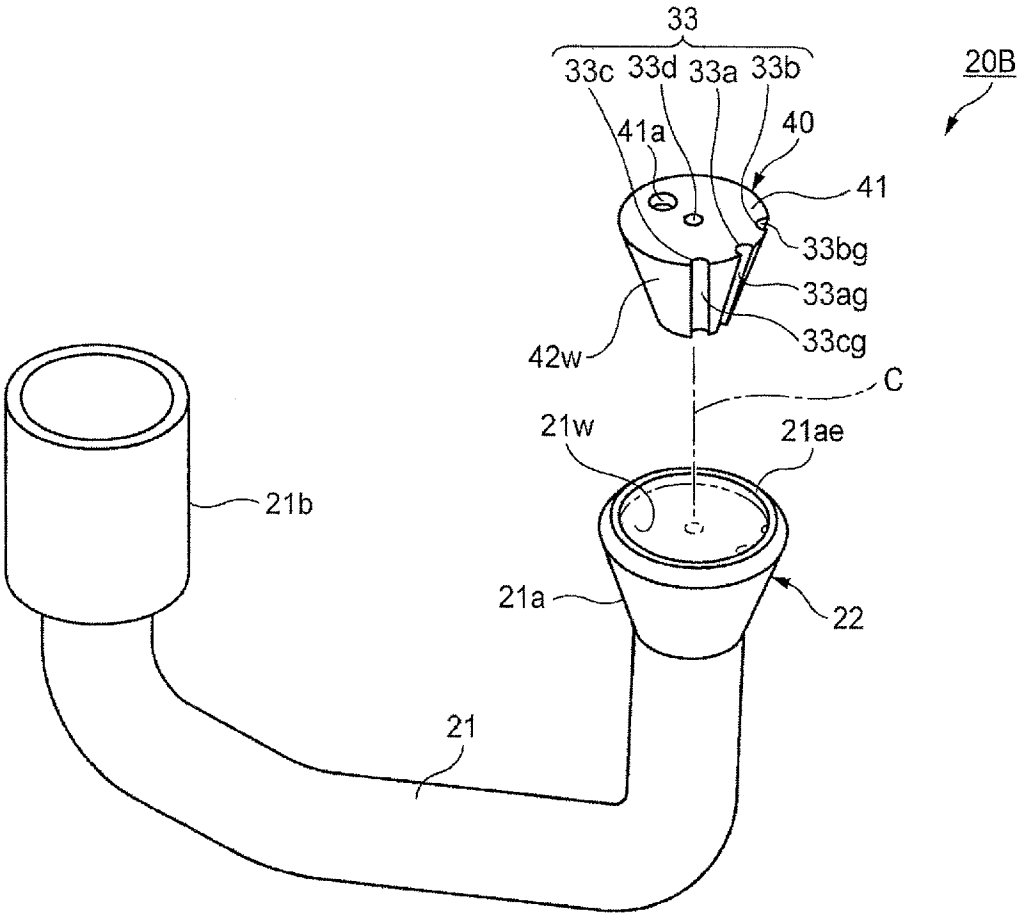
FIG. 9 is a perspective view of a nozzle pipe portion and a flow path forming member of a cooling system of a second embodiment.

In this embodiment, FIG. 9 shows a nozzle pipe portion 21 and a flow path forming member 40 of a cooling system 20B before the flow path forming member 40 is fittingly inserted into the nozzle pipe portion 21. As with the first embodiment, an expanded pipe portion 21*a* of this nozzle pipe portion 21 includes an inner circumferential wall surface 21*w* which gradually expands diametrically towards a distal end edge 21*ae*. However, being different from the first embodiment, this inner circumferential wall surface 21*w* has a circular cross-sectional shape. On the other hand, the flow path forming member 40 has an inverted frustum of circular cone shape and includes an outer circumferential wall surface 42*w* which corresponds to the inner circumferential wall surface 21*w* of the expanded pipe portion 21*a* and which has a cross-sectional shape which corresponds to that of the inner circumferential wall surface 21*w*. Consequently, the flow path forming member 40 can fittingly be inserted in the expanded pipe portion 21*a* in every orientation (orientation around an axis C of the expanded pipe portion 21*a*). However, a circularly depressed identification portion 41*a* is provided in a distal end face 41 of the flow path forming member 40 which is exposed at a distal end side of the expanded pipe portion 21*a*, so that the orientation of the flow path forming member 40 can be identified.

This identification portion 41*a* will be described in detail. When the flow path forming member 40 is fittingly inserted into the expanded pipe portion 21*a*, in order to set an installing orientation (an orientation in a circumferential direction around the axis C) of the flow path forming member 40, the identification portion 41*a* can be made use of, for example, to identify the orientation of the flow path forming member 40 by the use of an image recognition device to control the movement of a chucking device in an installing step so as to install the flow path forming member 40 in the expanded pipe portion 21*a* by setting the installing orientation of the flow path forming member 40 to a desired direction by the chucking device.

Additionally, the timing at which the orientation of the flow path forming member 40 is identified is when the flow path forming member 40 is chucked, or after the flow path forming member 40 is chucked, or further, before locking portions 21*ak* (refer to FIGS. 3 and 6) are formed after the flow path forming member 40 is installed in the expanded pipe portion 21*a*.

Additionally, the device for identifying the identification portion 41*a* is not limited to the image recognition device. Thus, in addition to the image recognition device, for example, a projecting member which can fit in the identification portion 41*a* may be used to identify the identification portion 41*a*.

In this way, according to the identification portion 41*a* of this embodiment, the installing orientation of the flow path forming member 40 around the axis C of the expanded pipe portion 21*a* can be identified when the flow path forming member 40 is fittingly inserted into the expanded pipe portion 21*a*, and the installing orientation of the flow path forming member 40 can easily be set. Consequently, an oil jetting direction can be set to a desired direction by installing the flow path forming member 40 in the expanded pipe portion 21*a*. In particular, since the identification portion 41*a* is provided on the distal end face 41 of the flow path forming member 40, the identification portion 41*a* can be formed extremely easily, and moreover, the identification portion 41*a* can easily be visualized from the outside and hence is useful as a device for verifying the inserting orientation of the flow path forming member 40. In particular, when a plurality of oil jetting paths 33 are formed in the flow path forming member 40 as in this embodiment, respective jetting directions of the oil jetting paths 33 can be set with good accuracy only by installing and fixing the flow path forming member 40 in place in the expanded pipe portion 21*a*, whereby a piston can be cooled with good efficiency.

Figure 10A:
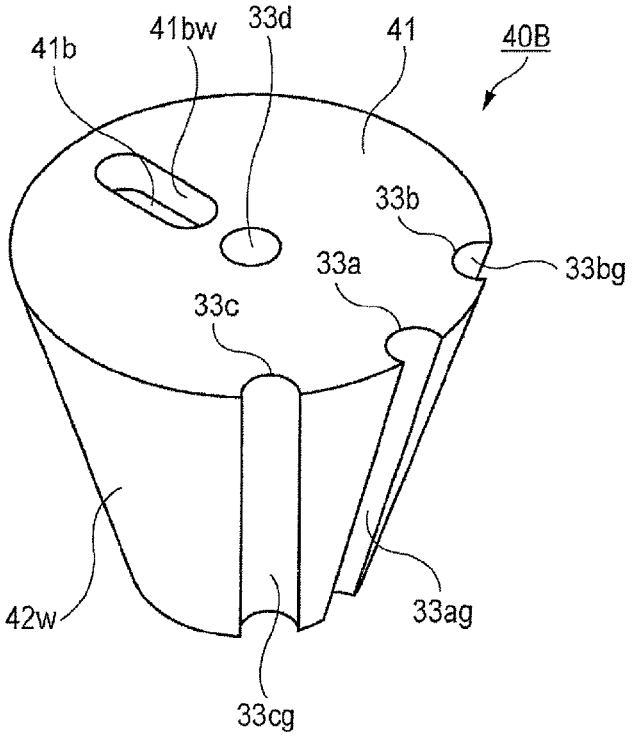
Figure 10B:
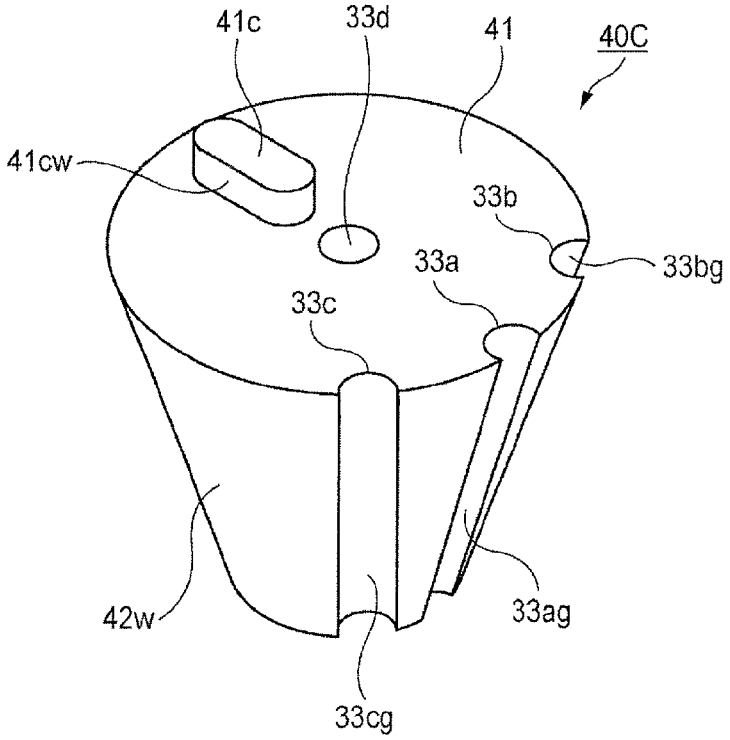

In this embodiment, the identification portion 41*a* does not have to be formed into the circularly depressed shape as shown in FIG. 9, and hence, the identification portion 41*a* can have shapes like those shown FIGS. 10A and 10B.

An identification portion 41*b* shown in FIG. 10A is configured as a groove having a shape which is elongated along a radial direction of a distal end face 41. In the case of this identification portion 41*b*, a side wall 41*bw* extends along the radial direction of the distal end face 41. Consequently, when a flow path forming member 40B is installed in the expanded pipe portion 21*a*, the side wall 41*bw* is made use of as an identification portion which identifies a proper orientation of the flow path forming member 40B when it is chucked or an identification portion for image recognition, whereby the position of the flow path forming member 40B can be controlled with good accuracy when it is installed in the expanded pipe portion 21*a*.

In a flow path forming member 40C shown in FIG. 10B, an identification portion 41*c* is formed into a projection which is elongated along a radial direction of a distal end face 41. A side wall 41*cw* of this identification portion 41*c* also extends along the radial direction of the distal end face 41, and when the flow path forming member 40C is installed in the expanded pipe portion 21*a*, the side wall 41*bc* is made use of as an identification portion which identifies a proper orientation of the flow path forming member 40C when it is chucked or an identification portion for image recognition, whereby the position of the flow path forming member 40C can be controlled with good accuracy when it is installed in the expanded pipe portion 21*a*.

(Third Embodiment)

Hereinafter, a third embodiment of the invention will be described by reference to FIGS. 11 and 12.

In the third embodiment, too, the illustration and description of constructions like to those described in the first embodiment will be omitted, and only constructions which are different from those of the first embodiment and peripheral constructions thereof will be illustrated. Additionally, like reference numerals will be given to like constituent elements to those of the first embodiment. FIG. 11 is a perspective view of a nozzle pipe portion and a flow path forming member of the third embodiment, and FIG. 12 is a sectional view of a portion taken along the line B-B in FIG. 11.

Figure 11:
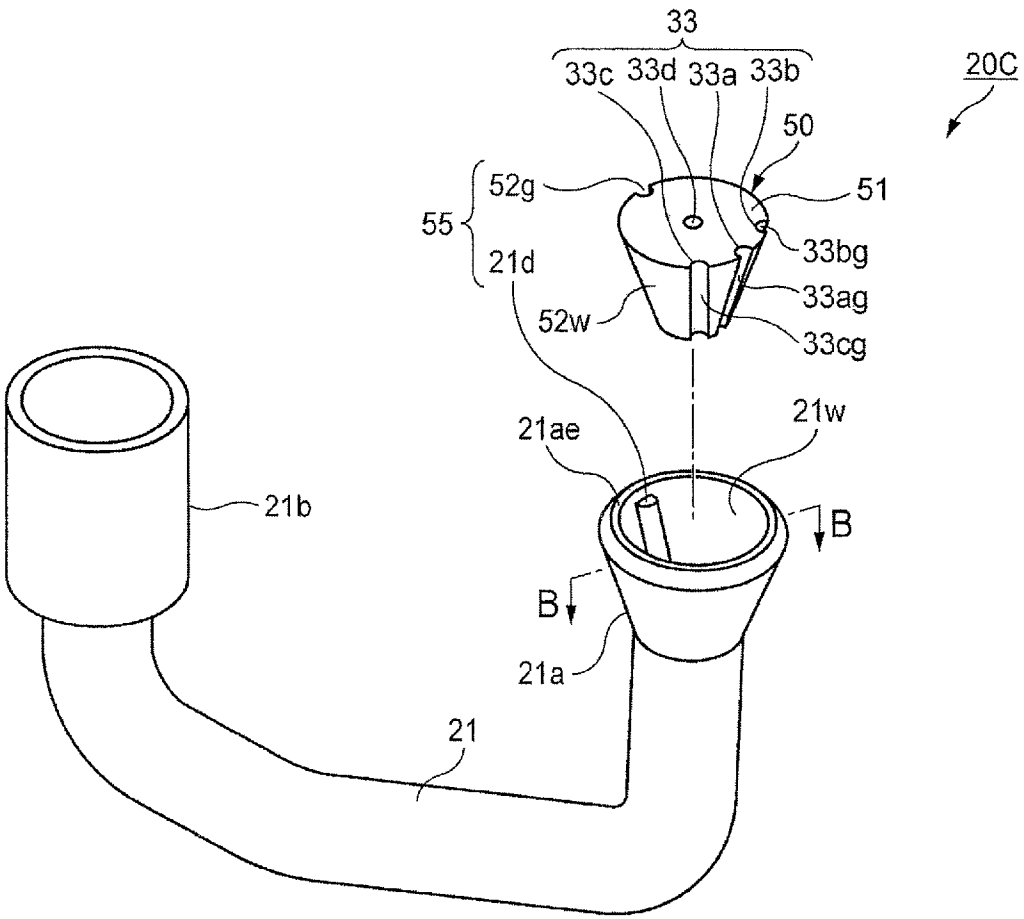
FIG. 11 is a perspective view of a nozzle pipe portion and a flow path forming member of a cooling system of a third embodiment.
Figure 12:
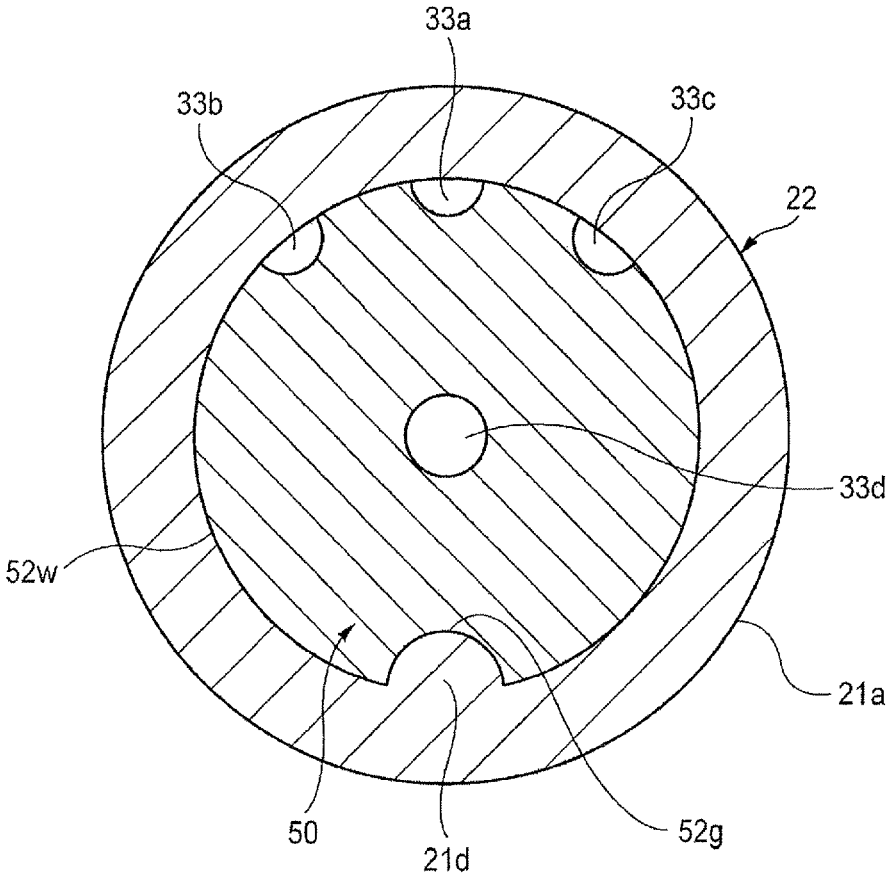
FIG. 12 is a sectional view of a portion which is taken along the line B-B in FIG. 11.

Similar to the case of the second embodiment, FIG. 11 shows a nozzle pipe portion 21 and a flow path forming member 50 of a cooling system 20C before the flow path forming member 50 is installed in the nozzle pipe portion 21. Similar to the second embodiment, an expanded pipe portion 21*a* of the nozzle pipe portion 21 includes an inner circumferential wall surface 21*w* which has a circular cross-sectional shape and which is formed so as to gradually expand diametrically towards a distal end edge 21*ae*. Additionally, an elongated projection 21*d* is provided on the inner circumferential wall surface 21*w* so as to extend along a vertical direction of the inner circumferential wall surface 21*w*. On the other hand, the flow path forming member 50 has an inverted frustum of circular cone shape and includes an outer circumferential wall surface 52*w* which corresponds to the inner circumferential wall surface 21*w* of the expanded pipe portion 21*a*. A position aligning groove 52*g* is formed so as to extend along a vertical direction on the outer circumferential wall surface 52*w* in a position on an opposite side to a side where first to third oil jetting paths 33*a*, 33*b*, 33*c* are formed, and this position aligning groove 52*g* is adapted to allow the elongated projection 21*d* to fit therein.

In this way, a rotation restricting portion 55 which restricts an installing orientation of the flow path forming member 50 is formed by the elongated projection 21*d* and the position aligning groove 52*g*. Consequently, when the flow path forming member 50 is fittingly inserted into the expanded pipe portion 21*a*, the flow path forming member 50 is installed in such an orientation that the elongated projection 21*d* coincides with the position aligning groove 52*g*. With the flow path forming member 50 installed in the expanded pipe portion 21*a*, as shown in FIG. 12, the elongated projection 21*d* fits in the position aligning groove 52*g*, whereby the installing orientation of the flow path forming member 50 is set accurately.

In addition, a cross-sectional shape of the elongated projection 21*d* is not limited to a semi-circular shape, and hence, the elongated projection 21*d* may have a tapered construction in which a cross-sectional area thereof is reduced as it extends upwards in a longitudinal direction (a vertical direction in FIG. 11) of the elongated projection 21*d*. This tapered construction can constitute a guiding construction in which the flow path forming member 50 is guided when it is installed in the expanded pipe portion 21*a*, thereby making it possible to facilitate the installation of the flow path forming member 50 into the expanded pipe portion 21*a*.

In this rotation restricting portion 55 of this embodiment, too, similar to the embodiments described above, the position aligning groove 52*g* can be made use of, for example, to set the installing orientation of the flow path forming member 50 by a chucking device in an installation step. Consequently, the installing orientation of the flow path forming member 50 can easily be set, and respective oil jetting directions of the oil jetting paths can easily be set by installing the flow path forming member 50 into the expanded pipe portion 21*a*. Moreover, the rotation restricting portion 55 is easily visualized from the outside and is made easy to be made use of as a device for verifying the inserting orientation of the flow path forming member 50, and therefore, the rotation restricting portion 55 can also be used as an identification portion which identifies the installing orientation of the flow path forming member 50 when it is chucked by the chucking device.

(Fourth Embodiment)

Figure 13:
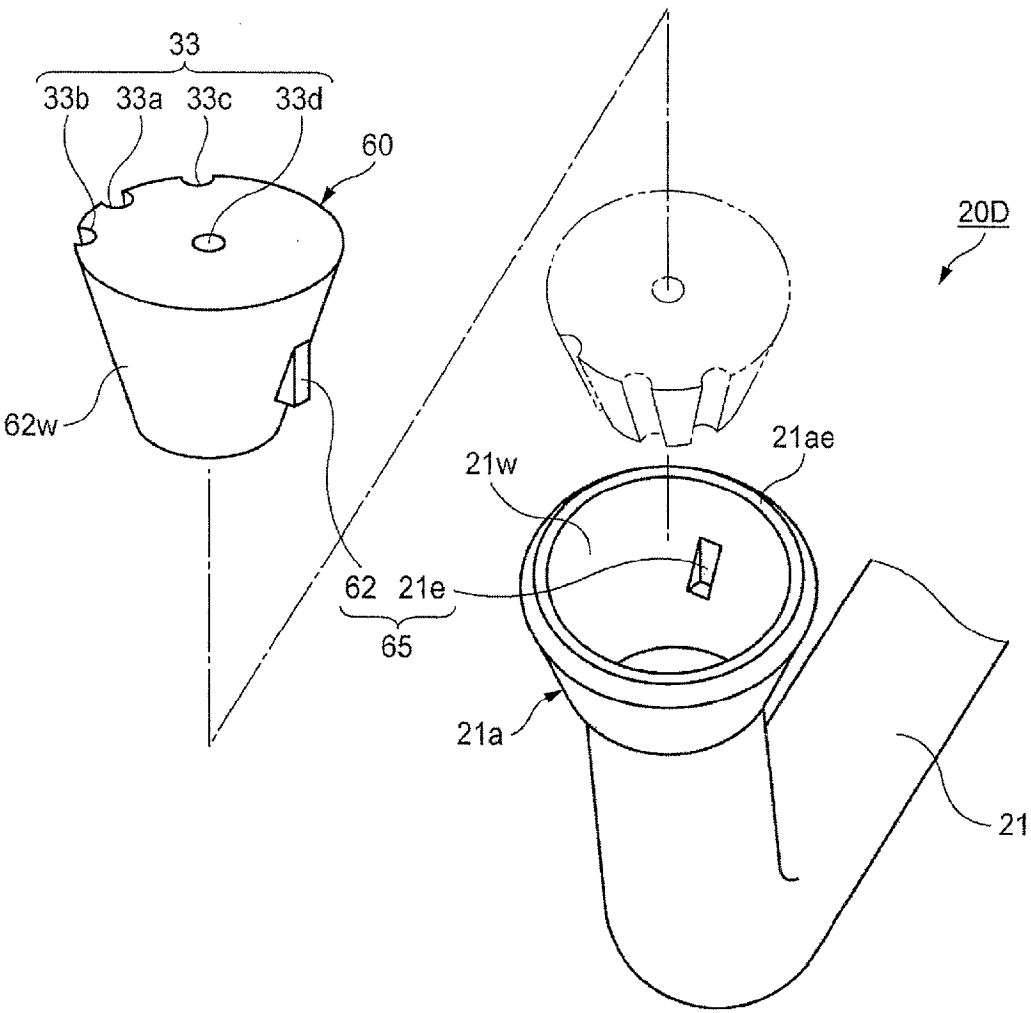
FIG. 13 is a perspective view of a nozzle pipe portion and a flow path forming member of a cooling system of a fourth embodiment.

Hereinafter, a fourth embodiment of the invention will be described by reference to FIG. 13.

In the fourth embodiment, too, the illustration and description of constructions like to those described in the first embodiment will be omitted, and only constructions which are different from those of the first embodiment and peripheral constructions thereof will be illustrated. Additionally, like reference numerals will be given to like constituent elements to those of the first embodiment. FIG. 13 is a perspective view of a nozzle pipe portion and a flow path forming member of a cooling system of the fourth embodiment. Similar to the case of the third embodiment, FIG. 13 shows a nozzle pipe portion 21 and a flow path forming member 60 of a cooling system 20D before the flow path forming member 60 is installed in the nozzle pipe portion 21.

In this embodiment, similar to the third embodiment, an expanded pipe portion 21*a* of the nozzle pipe portion 21 includes an inner circumferential wall surface 21*w* which has a circular cross-sectional shape and which is formed so as to gradually expand diametrically towards a distal end edge 21*ae*. Additionally, a depressed portion 21*e* is provided substantially at a vertically intermediate height position on the inner circumferential wall surface 21*w*. On the other hand, the flow path forming member 60 has an inverted frustum of circular cone shape and includes an outer circumferential wall surface 62*w* which corresponds to the inner circumferential wall surface 21*w* of the expanded pipe portion 21*a*. A position aligning projection 62 is formed on the outer circumferential wall surface 62*w* in a position on an opposite side to a side where first to third oil jetting paths 33*a*, 33*b*, 33*c* are formed, and this position aligning projection 62 is adapted to fit in the depressed portion 21*e*.

In this way, a rotation restricting portion 65 which restricts an installing orientation of the flow path forming member 60 is formed by the depressed portion 21*e* and the position aligning projection 62. When the flow path forming member 60 is fittingly inserted into the expanded pipe portion 21*a*, the flow path forming member 60 is installed in such an orientation that the depressed portion 21*e* coincides with the position aligning projection 62. The position aligning projection 62 fits in the depressed portion 21*e*, whereby the installing orientation of the flow path forming member 60 is set accurately.

In this rotation restricting portion 65 of this embodiment, too, similar to the third embodiment, the position aligning projection 62 can be made use of, for example, to set the installing orientation of the flow path forming member 60 by a chucking device in an installation step. Since the installing orientation of the flow path forming member 60 can easily be set by the position aligning projection 62, respective oil jetting directions of the oil jetting paths can easily be set by controlling the flow path forming member 60. Moreover, the rotation restricting portion 65 is easily visualized from the outside and is made easy to be made use of as a device for verifying the inserting orientation of the flow path forming member 60, and therefore, the rotation restricting portion 65 can also be used as an identification portion which identifies the installing orientation of the flow path forming member 60 when it is chucked by the chucking device.

(Fifth Embodiment)

Figure 14:
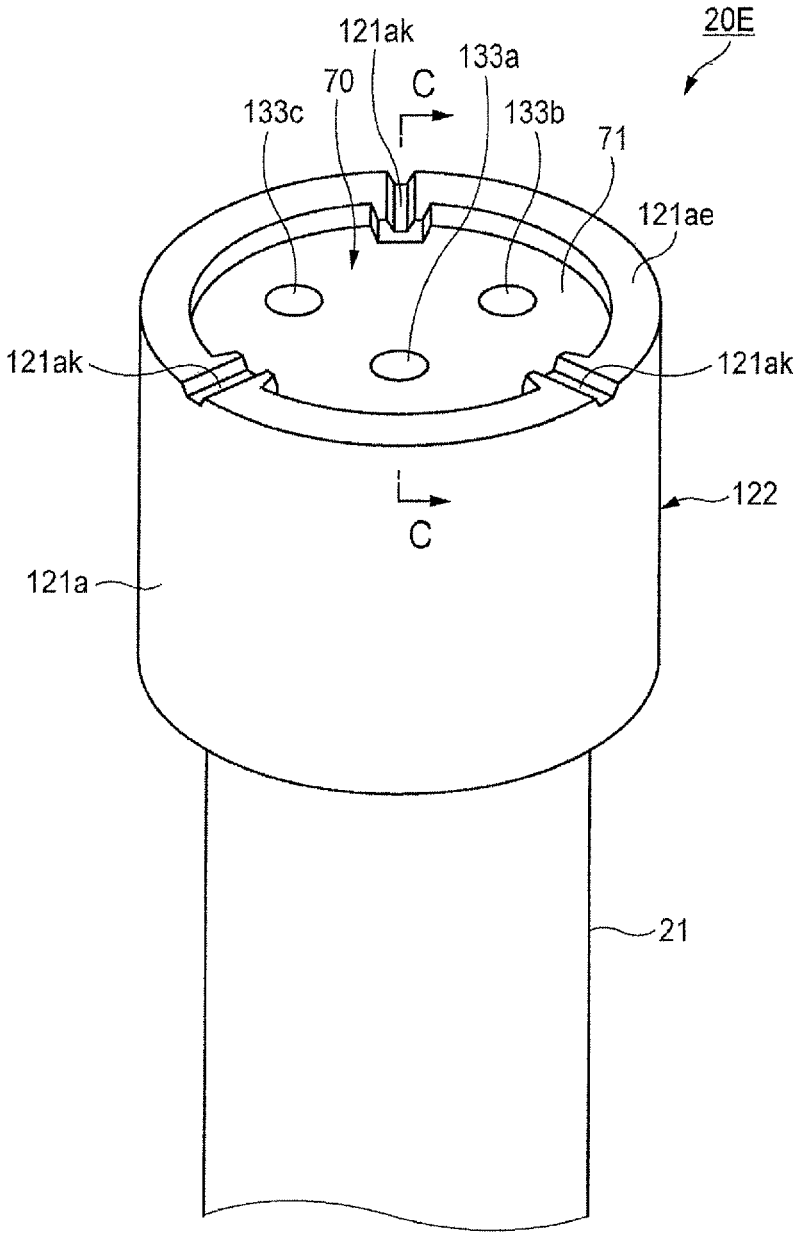
FIG. 14 is a perspective view of a nozzle pipe portion and a flow path forming member of a cooling system of a fifth embodiment.

Hereinafter, a fifth embodiment of the invention will be described by reference to FIGS. 14 and 15.

In the fifth embodiment, too, the illustration and description of constructions like to those described in the first embodiment will be omitted, and only constructions which are different from those of the first embodiment and peripheral constructions thereof will be illustrated. Additionally, like reference numerals will be given to like constituent elements to those of the first embodiment. FIG. 14 shows a perspective view of a distal end portion of a nozzle pipe portion of a cooling system of the fifth embodiment, and FIG. 15 shows a sectional view of a portion taken along the line C-C in FIG. 14. FIG. 14 shows a state in which a flow path forming member 70 is fittingly inserted into a nozzle portion 21 of a cooling system 20E and thereafter crimping is executed on the nozzle pipe portion 21.

Figure 15:
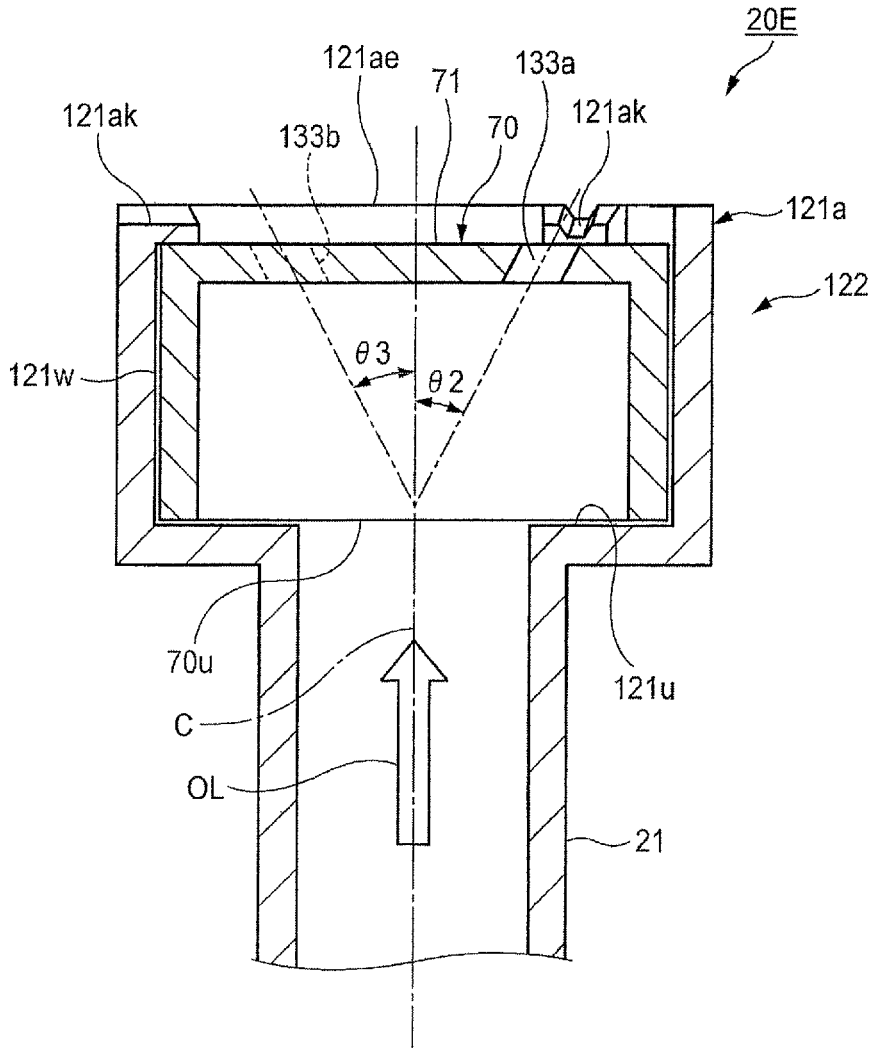
FIG. 15 is a sectional view of a portion taken along the line C-C in FIG. 14.

In this embodiment, being different from the embodiments that have been described heretofore, an expanded pipe portion 121*a* of a distal end portion 122 of the nozzle pipe portion 21 has a cylindrical inner circumferential wall surface 121*w* (refer to FIG. 15). Then, a cylindrical flow path forming member 70 is provided so as be in contact with the inner circumferential wall surface 121*w* of the expanded pipe portion 121*a*. A first oil jetting path 133*a*, a second oil jetting path 133*b* and a third oil jetting path 133*c* are provided in a distal end face 71 of the flow path forming member 70.

This flow path forming member 70 is formed from a synthetic resin through injection molding or formed of a metal through pressing. Additionally, the flow path forming member 70 is pressed downwards from thereabove by three locking portions 121*ak* which are provided along a distal end edge 121*ae* to thereby be locked with a lower end portion 70*u* thereof kept in abutment with a step portion 121*u* of the expanded pipe portion 121*a*.

In addition, respective oil jetting directions of the first oil jetting path 133*a*, the second oil jetting path 133*b* and the third oil jetting path 133*c* are set to appropriate inclination angles θ2, θ3 so as to be desirably directed with respect to an axis C of the expanded pipe portion 121*a*, as shown in FIG. 15. Namely, the first oil jetting path 133*a* can be set to the inclination angle θ2 so as to be directed towards, for example, a close-to-spark-plug location P1 (refer to FIG. 8), and the second oil jetting path 133*b* can be set to the inclination angle θ3 so as to be directed towards, for example, a close-to-exhaust-port location P2 (refer to FIG. 8).

In this embodiment, there is provided the holding construction in which the flow path forming member 70 is inserted into the expanded pipe portion 121*a* of the nozzle pipe portion 21 and the distal end edge 121*ae* of the expanded pipe portion 121*a* is crimpled partially so that the flow path forming member 70 is locked in the expanded pipe portion 121*a*. Therefore, welding or bonding becomes unnecessary, whereby the production process of the cooling system 20E is simplified, thereby making it possible to realize a reduction in production costs. Additionally, the flow path forming member 70 can be held strongly and rigidly against a pressure exerted on the flow path forming member 70 in the direction of the axis of the expanded pipe portion 121*a* by the pressure of oil or vibrations of an internal combustion engine. Moreover, the construction of the cooling system 20E can be simplified, and therefore, the enlargement of the cooling system 20E can be avoided.

(Sixth Embodiment)

Figure 16:
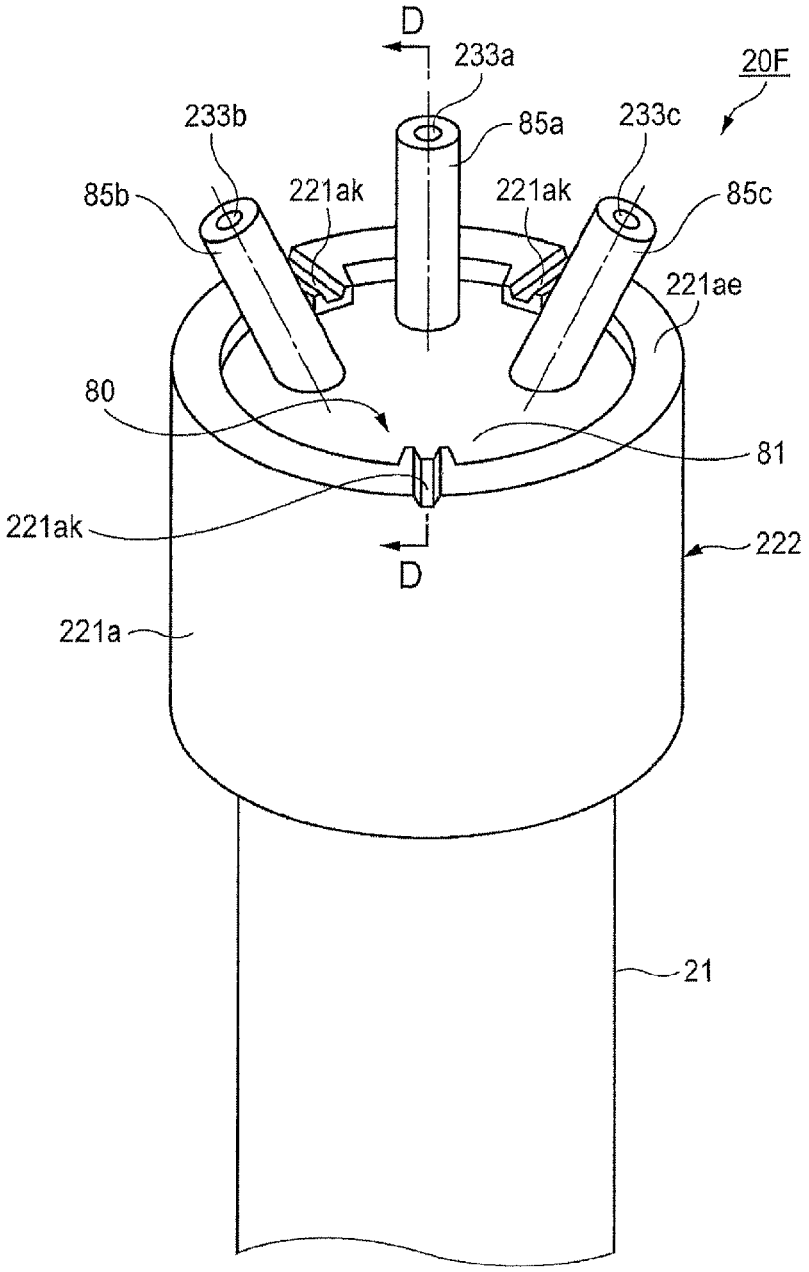
FIG. 16 is a perspective view of a nozzle pipe portion and a flow path forming member of a cooling system of a sixth embodiment.

Hereinafter, a sixth embodiment of the invention will be described by reference to FIGS. 16 and 17.

In the sixth embodiment, too, like reference numerals will be given to like constructions to those of the fifth embodiment, and the description thereof will be omitted as required. FIG. 16 shows a perspective view of a distal end portion of a nozzle pipe portion of a cooling system of the sixth embodiment, and FIG. 17 shows a sectional view of a portion taken along the line D-D in FIG. 16. Similar to the case of the fifth embodiment, FIG. 16 shows a state in which a flow path forming member 80 is fittingly inserted into a nozzle portion 21 of a cooling system 20F and thereafter crimping is executed on the nozzle pipe portion 21.

In this embodiment, a distal end portion 222 of the nozzle pipe portion 21 includes an expanded pipe portion 221 which has a cylindrical inner circumferential wall surface 221*w* (refer to FIG. 17) which is similar to that of the fifth embodiment. Additionally, the flow path forming member 80 has a cylindrical shape and includes three pipe members 85*a*, 85*b*, 85*c* which are provided on a distal end face 81 so as to project obliquely upwards therefrom. These three pipe members 85*a*, 85*b*, 85*c* constitute a first oil jetting path 233*a*, a second oil jetting path 233*b* and a third oil jetting path 233*c*, respectively.

This flow path forming member 80 can be formed from a synthetic resin through injection molding or formed of a metal. In addition, the flow path forming member 80 is pressed downwards from thereabove by three locking portions 221*ak* which are provided along a distal end edge 221*ae* to thereby be locked with a lower end portion 80*u* thereof kept in abutment with a step portion 221*u* of the expanded pipe portion 221*a*.

Figure 17:
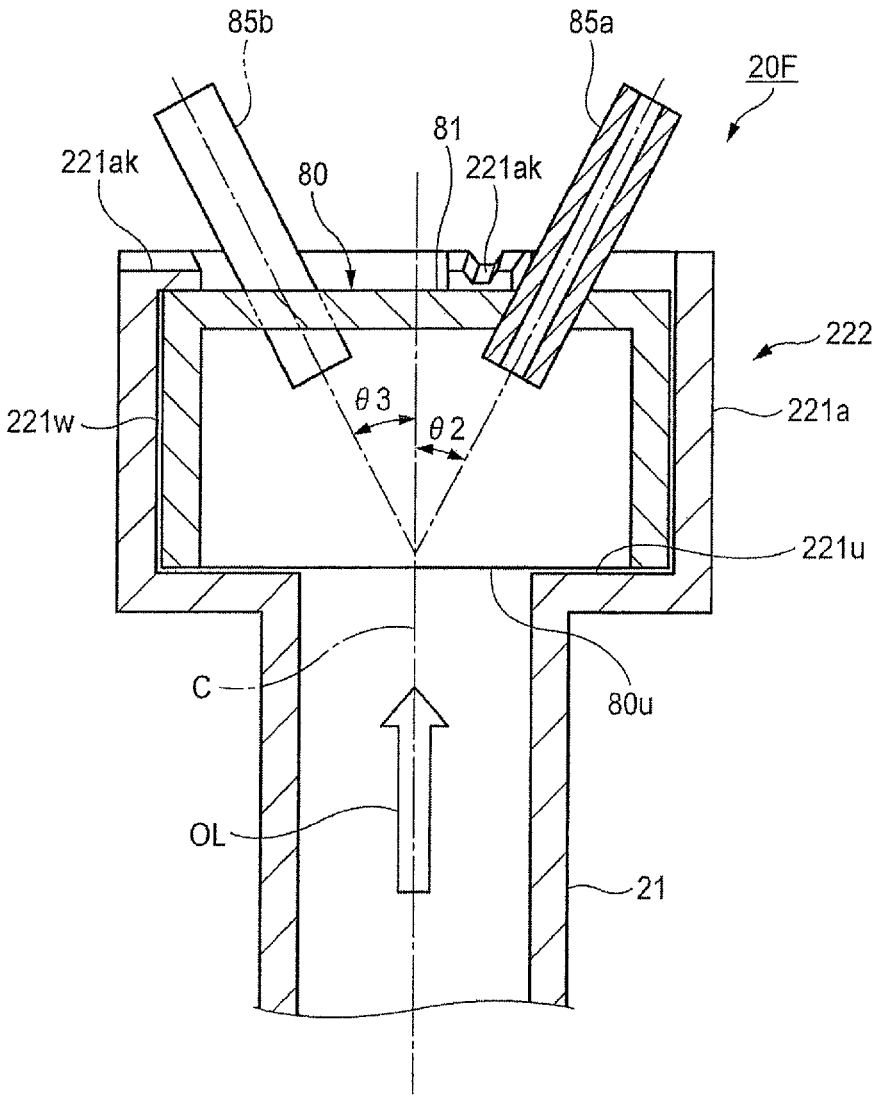
FIG. 17 is a sectional view of a portion taken along the line D-D in FIG. 16.

In addition, respective oil jetting directions of the first oil jetting path 233*a*, the second oil jetting path 233*b* and the third oil jetting path 233*c* are set to appropriate inclination angles θ2, θ3 so as to be desirably directed with respect to an axis C of the expanded pipe portion 221*a*, as shown in FIG. 17. Thus, similar to the case of the fifth embodiment, the oil jetting directions are directed to heat spots HS (refer to FIG. 8) for efficient cooling.

In this embodiment, too, there is provided the holding construction in which the flow path forming member 80 is inserted into the expanded pipe portion 221*a* of the nozzle pipe portion 21 and the distal end edge 221*ae* of the expanded pipe portion 221*a* is crimpled partially so that the flow path forming member 80 is locked in the expanded pipe portion 221*a*. Therefore, welding or bonding becomes unnecessary, whereby the production process of the cooling system 20F is simplified, thereby making it possible to realize a reduction in production costs. Additionally, the flow path forming member 80 can be held strongly and rigidly against a pressure exerted on the flow path forming member 80 in the direction of the axis of the expanded pipe portion 221*a* by the pressure of oil or external forces such as vibrations of an internal combustion engine. Moreover, the construction of the cooling system 20F can be simplified, and therefore, the enlargement of the cooling system 20F can be avoided.

(Seventh Embodiment)

Hereinafter, a seventh embodiment of the invention will be described by reference to FIGS. 18 to 20.

In the seventh embodiment, the illustration and description of constructions like to those described in the first embodiment will be omitted, and only constructions which are different from those of the first embodiment and peripheral constructions thereof will be illustrated. Additionally, like reference numerals will be given to like constituent elements to those of the first embodiment. FIG. 18 is a perspective view of a nozzle pipe portion and a flow path forming member of a cooling system of the seventh embodiment, FIG. 19 is a perspective view of the nozzle pipe portion and the flow path forming member of the cooling system, and FIG. 20 is a sectional view of a portion taken along the line E-E in FIG. 18.

Figure 18:
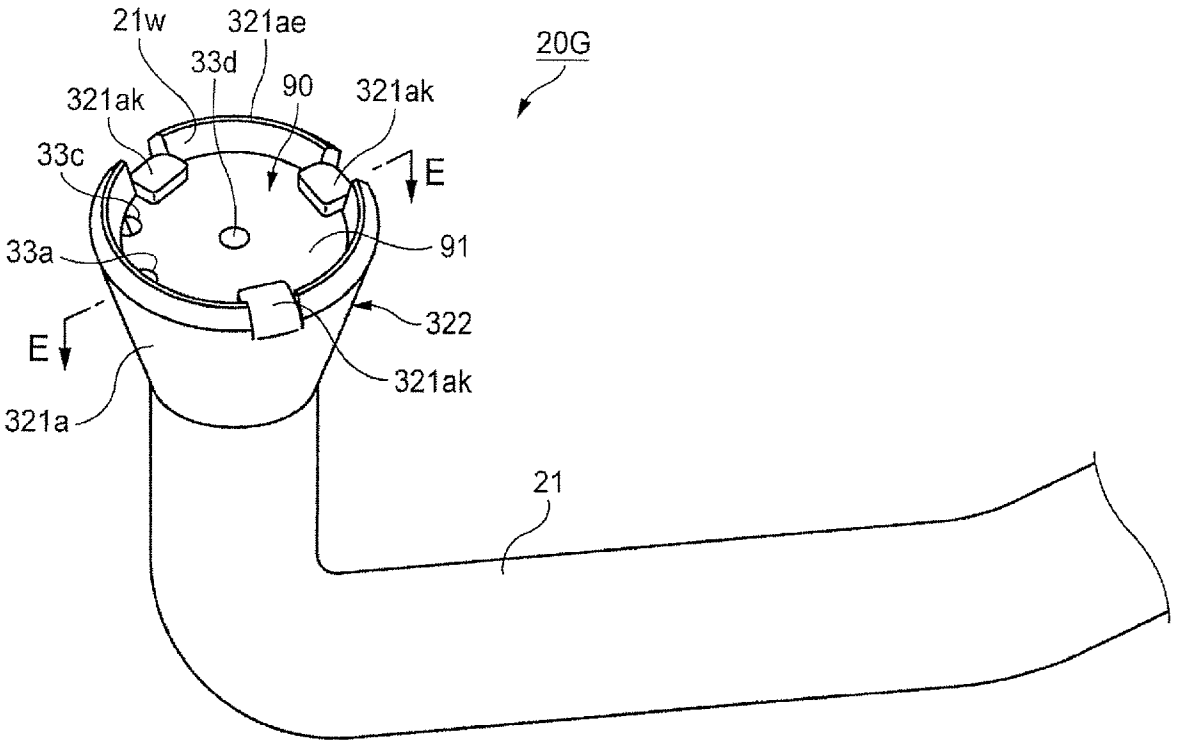
FIG. 18 is a perspective view showing a main part of a piston cooling system of a seventh embodiment.
Figure 19:
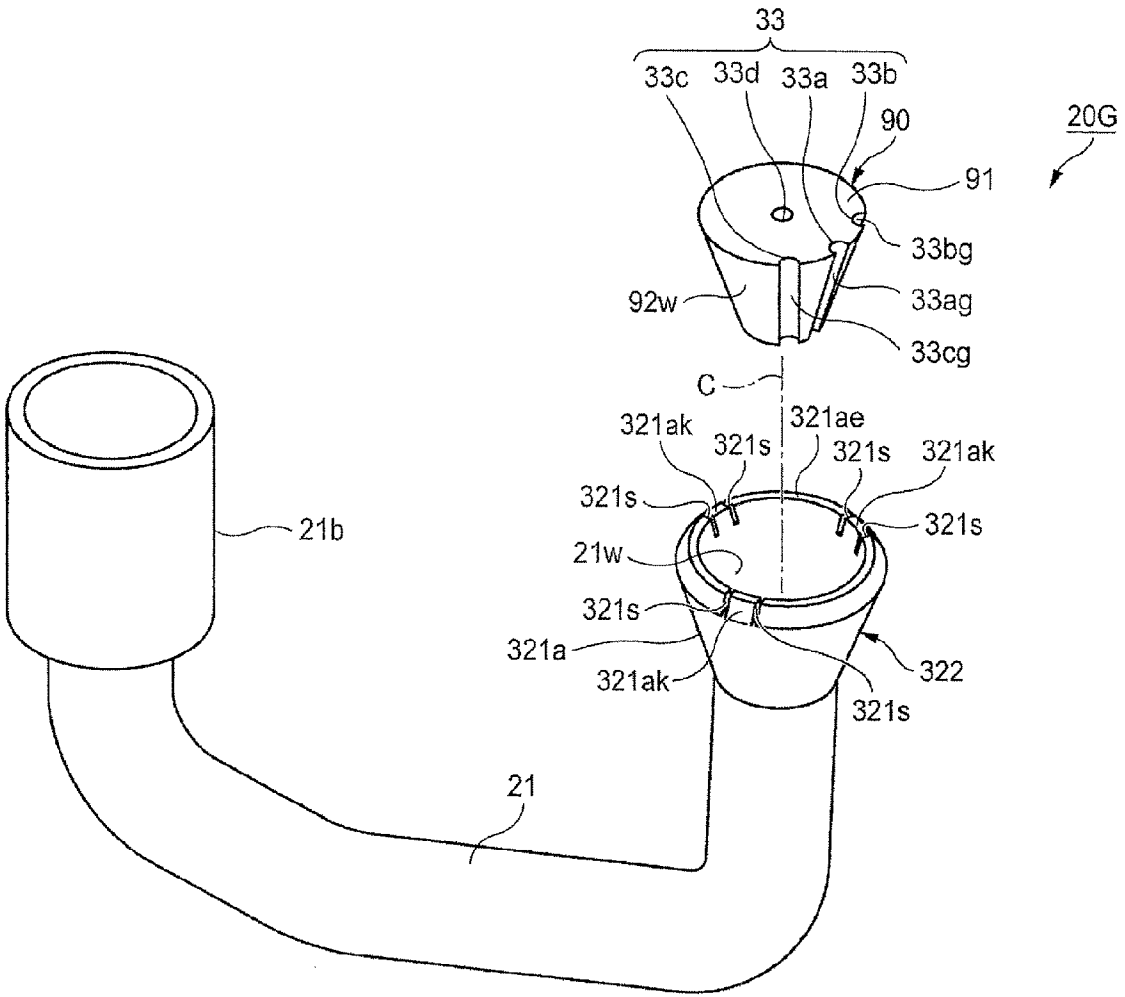
FIG. 19 is a perspective view of a nozzle pipe portion and a flow path forming member of the cooling system of the seventh embodiment.

Similar to the first embodiment, oil jetting paths 33 of this embodiment include a total of four oil jetting paths which are formed so as to open upwards towards an interior of a cylinder bore 10: they are, as shown in FIG. 18, a first oil jetting path 33*a*, a second oil jetting path 33*b* (refer to FIG. 19) and a third oil jetting path 33*c* which are formed along an outer circumferential edge of a distal end face 91 of a flow path forming member 90 and a fourth oil jetting path 33*d* which is formed substantially in the center of the distal end face 91. Additionally, FIG. 19 shows a state resulting before the flow path forming member 90 is fittingly inserted into the nozzle pipe portion 21 of a cooling system 20G. Similar to the second embodiment, an expanded pipe portion 321*a* of this nozzle pipe portion 21 has an inner circumferential wall surface 21*w* which has a circular cross-sectional shape and which is formed so as to gradually expand diametrically towards a distal end edge 321*ae*, and groove portions 33*ag*, 33*bg*, 33*cg* are formed in an outer circumferential surface 92*w* of the flow path forming member 90.

In addition, in this embodiment, being different from the embodiments that have been described heretofore, six slits 321 are formed circumferentially at predetermined intervals in the distal end edge 321*ae*. Namely, three locking portions 321*ak* which are not yet bent are formed by these slits 321*s*.

Consequently, after the flow path forming member 90 is installed in the expanded pipe portion 321*a*, the locking portions 321*ak* which are formed by the slits 321*s* are bent towards the distal end surface 91. These bent locking portions 321*ak* are situated in positions which deviate from the oil jetting paths 33.

Figure 20:
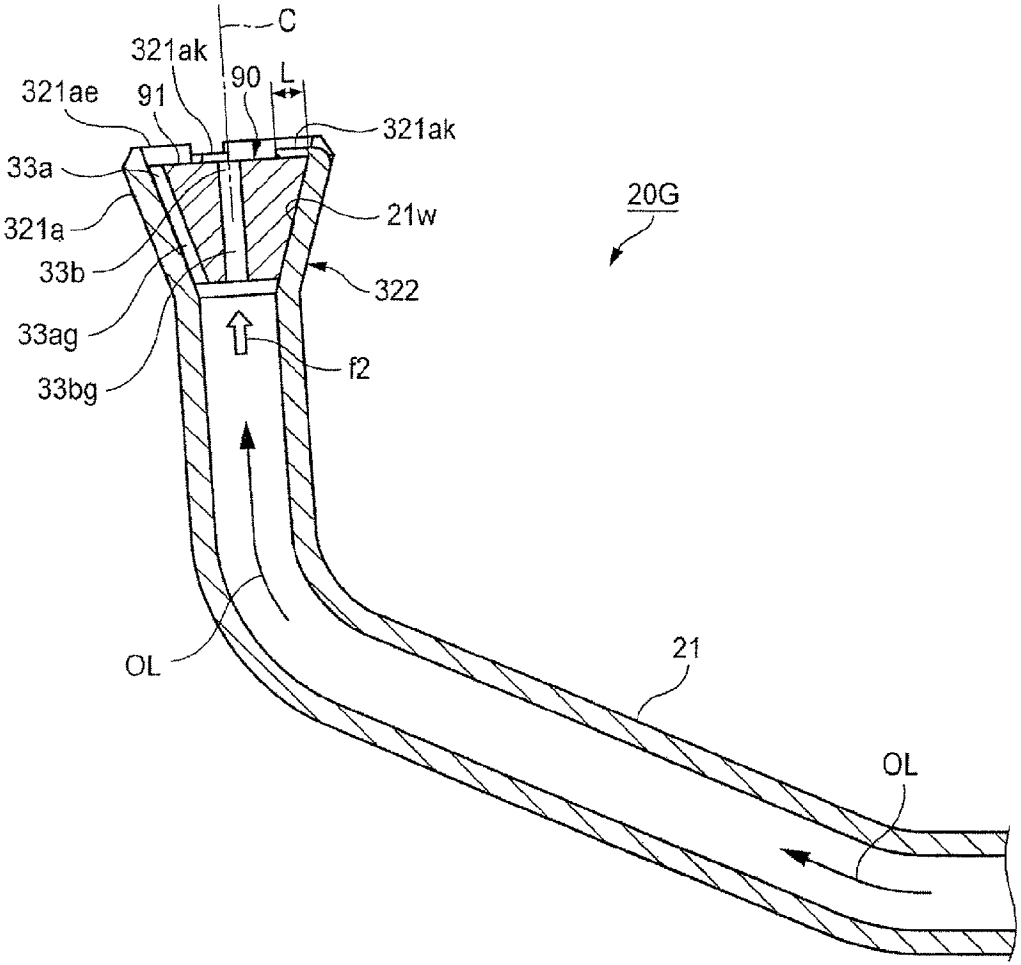
FIG. 20 is a sectional view of a portion taken along the line E-E in FIG. 18.

In addition, as shown in FIG. 20, a length L of the locking portion 321*ak* over which the distal end face 91 is pressed can be increased by making a height of the distal end edge 321*ae* resulting when the flow path forming member 90 is installed in the expanded pipe portion 321*a* higher than the distal end face 91 and increasing the slit 321*s*. Consequently, The length L can easily be increased, whereby the locking force of the locking portion 321*ak* can easily be increased.

Additionally, it is also possible to increase the locking force by increasing the length L of only the locking portion 321*ak* larger than the distal end edge 321*ae*.

In this way, in the case of the configuration being adopted in which the flow path forming member is locked by the locking portions 321*ak* which are provided on the distal end edge 321*ae*, it becomes easy to ensure or adjust the locking amount of the locking portions 321*ak*.

Thus, in the first to seventh embodiments, while the cooling points P are described as being provided in the three or four locations, the invention is not limited thereto, and hence, the cooling points P may be provided in two or five locations. Additionally, in the embodiments described above, while the cooling system is described as having one nozzle pipe portion 21 in the cylinder bore, the invention is not limited thereto, and hence, there may be provided a cooling system having a construction in which a plurality of nozzle pipe portions 21 are provided within a cylinder bore.

Additionally, the external configuration of the flow path forming member is not limited to the circular or elliptic shape, and hence, a polygonal shape may be adopted.

In addition, while the embodiments are described as being applied to the cooling system for the piston of the internal combustion engine of the motorcycle, the invention is not limited thereto, and hence, the invention can be applied to various types of internal combustion engines for an ATV, a four-wheel motor vehicle and the like.

Further, in the embodiments, while the locking portions are formed by crimping or bending part of the distal end edge of the expanded pipe portion, the locking portions may be formed by a combination of crimping and bending. In addition, the number of locking portions formed and the shape thereof are not limited to those described in the embodiments. Additionally, in addition to the locking of the flow path forming portion by the locking portions, a configuration may be adopted in which a side wall portion of the expanded pipe portion is also crimped.

In addition, the sizes of flow paths of the oil jetting paths may be set to be different individually.

What is claimed is:

1. A piston cooling system comprising:

a nozzle pipe portion which communicates with an oil passage which is provided in an internal combustion engine and which extends towards an interior of a cylinder bore; and a flow path forming member which is fixed to a distal end portion of the nozzle pipe portion and in which a plurality of oil jetting paths are formed to thereby cool a piston within the cylinder bore by jetting oil from the oil jetting paths towards a back side of the piston, wherein:

the distal end portion comprises an expanded pipe portion where the nozzle pipe portion is expanded and the flow path forming member is fittingly inserted into the expanded pipe portion;

the flow path forming member has a distal end face which is exposed to an exterior portion at a distal end side of the expanded pipe portion; and the flow path forming member is locked in the expanded pipe portion by deforming a distal end edge of the expanded pipe portion so as to provide a locking portion which locks the distal end face of the flow path forming member.

2. The piston cooling system according to claim 1, wherein the distal end edge of the expanded pipe portion projects further towards the distal end side of the expanded pipe portion than the distal end face of the flow path forming member in such a state that the flow path forming member is inserted into the expanded pipe portion.

3. The piston cooling system according to claim 1, wherein:

the expanded pipe portion has a tapered inner circumferential wall surface which is formed so as to gradually expand towards the distal end edge;

the flow path forming member has a tapered outer circumferential wall surface which corresponds to the inner circumferential wall surface and groove portions are formed in the outer circumferential wall surface; and the oil jetting paths are formed by the inner circumferential wall surface and the groove portions.

4. The piston cooling system according to claim 3, wherein the nozzle pipe portion is formed of a metal, and a tapered angle of the inner circumferential wall surface of the expanded pipe portion is less than 30 degrees with respect to an axis of the nozzle pipe portion.

5. The piston cooling system according to claim 3, wherein a rotation restricting portion which restricts a rotational movement of the flow path forming member around an axis of the expanded pipe portion is formed between the inner circumferential wall surface of the expanded pipe portion and the outer circumferential wall surface of the flow path forming member.

6. The piston cooling system according to claim 1, wherein the flow path forming member is formed from a synthetic resin.

7. The piston cooling system according to claim 1, wherein:

the flow path forming member is locked in the expanded pipe portion by the locking portion which is provided at a circumferential portion on the distal end edge; and the locking portion is positioned to deviate from the oil jetting paths in a circumferential direction of the distal end edge.

8. The piston cooling system according to claim 1, wherein:

a spark plug and an exhaust port face a combustion chamber which is defined by the cylinder bore and the piston; and the oil jetting paths include at least a first oil jetting path which jets oil towards a close-to-spark-plug portion on the back side of the piston and a second oil jetting path which jets oil towards a close-to-exhaust-port portion on the back side of the piston.

9. The piston cooling system according to claim 1, wherein an identification portion which identifies a fittingly inserting orientation of the flow path forming member around the axis of the expanded pipe portion is provided on the distal end face so as to be depressed thereinto or project therefrom.

10. The piston cooling system according to claim 1, wherein the locking portion on the distal end edge is formed through at least either crimping or bending.

* * * * *